US007850424B2

(12) United States Patent
Takahashi et al.

(10) Patent No.: US 7,850,424 B2
(45) Date of Patent: Dec. 14, 2010

(54) STEAM TURBINE POWER PLANT

(75) Inventors: Seiko Takahashi, Kawasaki (JP); Ryuichi Ishii, Tokyo (JP); Yoichi Tsuda, Tokyo (JP); Nobuo Okita, Ushiku (JP); Katsuya Yamashita, Tokyo (JP); Yukio Shinozaki, Kawasaki (JP); Masafumi Fukuda, Saitama (JP); Takeo Takahashi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1197 days.

(21) Appl. No.: 11/652,580

(22) Filed: Jan. 12, 2007

(65) Prior Publication Data

US 2010/0251713 A1 Oct. 7, 2010

Related U.S. Application Data

(62) Division of application No. 10/901,370, filed on Jul. 29, 2004, now Pat. No. 7,238,005.

(30) Foreign Application Priority Data

Jul. 30, 2003 (JP) ..... P2003-283030
Jun. 18, 2004 (JP) ..... P2004-181536

(51) Int. Cl.
*F01D 5/28* (2006.01)
*C21D 9/00* (2006.01)

(52) U.S. Cl. ..... 415/200; 416/241 R

(58) Field of Classification Search ..... 415/99–103, 415/179, 198.1, 199.5, 200; 416/241 R
See application file for complete search history.

(56) References Cited

U.S. PATENT DOCUMENTS 6,102,654 A 8/2000 Oevnhausen et al.
7,404,699 B2 * 7/2008 Thamm et al. ..... 415/200

FOREIGN PATENT DOCUMENTS

EP 0 067 526 B1 11/1986
EP 0 210 122 B1 1/1990
EP 0 767 250 A2 4/1997
EP 1 304 394 A1 4/2003

(Continued)

OTHER PUBLICATIONS

Examiner's First Report issued by the Australian Patent Office on Sep. 25, 2006, in Australian Patent Application No. 2004203429.

(Continued)

*Primary Examiner*—Igor Kershteyn
(74) *Attorney, Agent, or Firm*—Finnegan, Henderson, Farabow, Garrett & Dunner, L.L.P.

(57) ABSTRACT

An intermediate-pressure turbine is divided into a high-temperature, high-pressure side high-temperature, intermediate-pressure turbine section 11*a* and a low-temperature, low-pressure side low-temperature, intermediate-pressure turbine section 11*b*, the component members of the high-temperature, intermediate-pressure turbine section 11*a* are formed of austenitic heat-resistant steels or Ni-based alloys, and the high-temperature, intermediate-pressure turbine section 11*a* is operated by steam having a temperature of 650° C. or more. Other turbines are mainly formed of ferritic heat-resistant steels. Thus, a steam turbine power plant having high thermal efficiency and being economical can be provided.

10 Claims, 8 Drawing Sheets

FOREIGN PATENT DOCUMENTS

| | | |
|---|---|---|
| JP | 46-32329 | 9/1971 |
| JP | 54-107416 | 8/1979 |
| JP | 60-70125 | 4/1985 |
| JP | 60-138054 | 7/1985 |
| JP | 60-54385 | 11/1985 |
| JP | 61-163238 | 7/1986 |
| JP | 62-60845 | 3/1987 |
| JP | 2-149649 | 6/1990 |
| JP | 6-306550 | 11/1994 |
| JP | 7-247806 | 9/1995 |
| JP | 8-3697 | 1/1996 |
| JP | 8-277703 | 10/1996 |
| JP | 10-183294 | 7/1998 |
| JP | 10-298682 | 11/1998 |
| JP | 10-317079 | 12/1998 |
| JP | 11-350911 | 12/1999 |
| JP | 3095745 | 8/2000 |
| JP | 2000-282808 | 10/2000 |
| JP | 2002-167655 | 6/2002 |
| JP | 2002-235134 | 8/2002 |

OTHER PUBLICATIONS

Office Action issued by the Japanese Patent Office on Dec. 24, 2008, for Japanese Patent Application No. 2004-181536, and English-language Summary thereof.

Office Action issued by the Chinese Patent Office on Dec. 8, 2006, in Chinese Patent Application No. 2004100557562, and English-language Summary thereof.

* cited by examiner

STEAM TURBINE POWER PLANT

CROSS-REFERENCE TO RELATED APPLICATIONS

This application is a divisional of application Ser. No. 10/901,370, filed Jul. 29, 2004 now U.S. Pat. No. 7,238,005, which is incorporated in its entirety herein by reference. This application is also based upon and claims the benefit of priority from prior Japanese Patent Application No. 2003-283030, filed on Jul. 30, 2003 and Japanese Patent Application No. 2004-181536, filed on Jun. 18, 2004; the entire contents of which are incorporated herein by reference.

BACKGROUND

1. Field of the Invention

The present invention relates to a steam turbine power plant provided with a high-temperature steam turbine, and more particularly to a steam turbine power plant provided with a steam turbine which has individual components comprised of suitable heat-resistant materials.

2. Description of the Related Art Conventionally, because the individual components configuring thermal power generation facilities are used under steam conditions including generally a steam temperature of 600° C. or less, ferritic heat-resistant steels having outstanding productivity and economical efficiency have been used for main members such as a turbine rotor, a turbine blade and the like which are exposed to high temperatures (see Japanese Patent Publication No. SHO 60-54385, and Japanese Patent Laid-Open Applications No. HEI 2-149649, No. HEI 6-306550 and No. HEI 8-3697).

In recent years, the thermal power generation facilities are positively made to be more efficient with environmental conservation as a background, and a steam turbine is operated using high-temperature steam having a temperature of about 600° C. Such a turbine has quite a few parts which cannot meet the required properties because of the various properties of the ferritic heat-resistant steels used. Therefore, austenitic heat-resistant steels and the like more excelling in high-temperature properties are used.

But, there were problems that the use of the austenitic heat-resistant steels increased the facility cost, and a thermal stress tended to occur at a time of change in load when the plant was activated or stopped because the austenitic heat-resistant steels had low thermal conductivity as compared with the ferritic heat-resistant steels and also had a high coefficient of linear expansion.

Therefore, it is proposed to configure a steam turbine generating system by restrictively using the austenitic heat-resistant steels for a steam turbine using steam having a temperature of 650° C. or more in comparison with a steam turbine using steam having a temperature of about 600° C. (see Japanese Patent Laid-Open Applications No. HEI 7-247806 and No. 2000-282808, and Japanese Patent No. 3095745). For such a steam turbine generating system, the austenitic heat-resistant steels having outstanding high-temperature properties are mainly used for a high-pressure turbine.

In the above-described steam turbine generating system, the high-pressure turbine is frequently set to have a pressure about four to six times higher than that of an intermediate-pressure turbine, so that the casing configuring the high-pressure turbine, a main steam pipe for guiding steam to the high-pressure turbine, boiler component members and the like are formed thick so to resist a high pressure.

But, the use of the thick austenitic heat-resistant steels increases the facility cost. Besides, the austenitic heat-resistant steels might generate an excessively high thermal stress at a time of change in load when the plant is activated or stopped because it has low thermal conductivity and a high coefficient of linear expansion. Therefore, it is necessary to suppress a load change rate to a low level at the time of activating or stopping the plant, and there are problems that operating characteristics are degraded considerably and the like in comparison with an ordinary steam generating plant.

BRIEF SUMMARY OF THE INVENTION

Under the circumstances described above, the present invention provides a steam turbine power plant which can suppress the facility cost from increasing, can suppress an excessively high thermal stress from generating at a time of change in load when the plant is activated or stopped and can obtain satisfactory operating characteristics with high thermal efficiency by restrictively using austenitic heat-resistant steels or Ni-based alloys for prescribed component members of an intermediate-pressure turbine.

The steam turbine power plant according to an aspect of the present invention is a steam turbine power plant comprising a high-pressure turbine, an intermediate-pressure turbine and a low-pressure turbine, the intermediate-pressure turbine being separated into a high-temperature, intermediate-pressure turbine into which high-temperature steam having steam exhausted from the high-pressure turbine reheated to 650° C. or more is introduced and a low-temperature, intermediate-pressure turbine into which steam exhausted from the high-temperature, intermediate-pressure turbine is introduced, wherein, at least one composing element of the high-pressure turbine, the low-temperature, intermediate-pressure turbine and the low-pressure turbine is formed of ferritic alloy steel, and a rotor and a casing of the high-temperature, intermediate-pressure turbine are formed of, on percentage by weight basis, one alloy selected from a group consisting of 1) to 4): 1) an alloy consisting of Ni: 50.0 to 55.0, Cr: 17.0 to 21.0, a total of Nb or Nb and Ta: 4.75 to 5.5, Mo: 2.8 to 3.3, Ti: 0.65 to 1.15, Al: 0.2 to 0.8, Co: 1.0 or less, C: 0.08 or less, Mn: 0.35 or less, Si: 0.35 or less, B: 0.006 or less and the balance of Fe and unavoidable impurities; 2) an alloy consisting of C: 0.25 or less, Si: 1.0 or less, Mn: 1.0 or less, Cr: 19.0 to 24.0, Co: 15.0 or less, Mo: 8.0 to 10.0, a total of Nb and Ta: 4.15 or less, Al: 1.5 or less, Ti: 0.6 or less, Fe: 20.0 or less, W: 1.0 or less, B: 0.01 or less and the balance of Ni and unavoidable impurities; 3) an alloy consisting of C: 0.2 or less, Si: 1.0 or less, Mn: 1.0 or, less, Cr: 12.0 to 21.0, Co: 22.0 or less, Mo: 10.5 or less, a total of Nb and Ta: 2.8 or less, Al: 0.4 to 6.5, Ti: 0.5 to 3.25, Fe: 9.0 or less, B: 0.02 or less, Zr: 4.0 or less and the balance of Ni and unavoidable impurities; and 4) an alloy consisting of C: 0.45 or less, Si: 1.0 or less, Mn: 2.0 or less, Cr: 19.0 to 25.0, Ni: 18.0 to 45.0, Mo: 2.0 or less, Nb: 0.1 to 0.4, W: 8.0 or less, Ti: 0.6 or less, Al: 0.6 or less, B: 0.01 or less, N: 0.25 or less and the balance of Fe and unavoidable impurities; and at least a first stage turbine blade of turbine blades constructed of plural stages of the high-temperature, intermediate-pressure turbine is formed of, on percentage by weight basis, one alloy selected from a group consisting of 5) to 9): 5) an alloy consisting of Ni: 50.0 to 55.0, Cr: 17.0 to 21.0, a total of Nb or Nb and Ta: 4.75 to 5.5, Mo: 2.8 to 3.3, Ti: 0.65 to 1.15, Al: 0.2 to 0.8, Co: 1.0 or less, C: 0.08 or less, Mn: 0.35 or less, Si: 0.35 or less, B: 0.006 or less and the balance of Fe and unavoidable impurities; 6) an alloy consisting of C: 0.25 or less, Si: 1.0 or less, Mn: 1.0 or less, Cr: 19.0 to 24.0, Co: 15.0 or less, Mo: 8.0 to 10.0, a total of Nb and Ta: 4.15 or less, Al: 1.5 or less, Ti: 0.6 or less, Fe: 20.0 or less, W: 1.0 or less, B: 0.01 or less and the balance of Ni and unavoidable impurities; 7) an alloy consisting of C: 0.2 or less, Si: 1.0 or less, Mn: 1.0 or less, Cr: 12.0 to 21.0, Co: 22.0 or less, Mo: 10.5 or less, a total of Nb and Ta: 2.8 or less, Al: 0.4 to 6.5, Ti: 0.5 to 3.25, Fe: 9.0 or less, B: 0.02 or less, Zr: 4.0 or less and the balance of Ni and unavoidable impurities; 8) an alloy consisting of C: 0.45 or less, Si: 1.0 or less, Mn: 2.0 or less, Cr: 19.0 to 25.0, Ni: 18.0 to 45.0, Mo: 2.0 or less, Nb: 0.1 to 0.4, W: 8.0 or less, Ti: 0.6 or less, Al: 0.6 or less, B: 0.01 or less, N: 0.25 or less and the balance of Fe and unavoidable impurities; and 9) an alloy consisting of C: 0.1 or less, Si: 1.5 or less, Mn: 1.0 or less, Cr: 11.0 to 20.0, a total of Ni and Co: 40.0 to 60.0, Mo: 2.5 to 7.0, Al: 0.35 or less, Ti: 2.3 to 3.1, Zr: 0.1 or less, B: 0.001 to 0.02 and the balance of Fe and unavoidable impurities.

The steam turbine power plant according to another aspect of the present invention is a steam turbine power plant comprising a high-pressure turbine, an intermediate-pressure turbine and a low-pressure turbine, the intermediate-pressure turbine being separated into a high-temperature, intermediate-pressure turbine into which high-temperature steam having steam exhausted from the high-pressure turbine reheated to 650° C. or more is introduced and a low-temperature, intermediate-pressure turbine into which steam exhausted from the high-temperature, intermediate-pressure turbine is introduced, wherein at least one composing element of the high-pressure turbine, the low-temperature, intermediate-pressure turbine and the low-pressure turbine is formed of ferritic alloy steel, and a rotor of the high-temperature, intermediate-pressure turbine is comprised of plural components, and the individual components are formed of, on percentage by weight basis, any alloy selected from a group consisting of 1-1) to 4-1): 1-1) an alloy consisting of Ni: 50.0 to 55.0, Cr: 17.0 to 21.0, a total of Nb or Nb and Ta: 4.75 to 5.5, Mo: 2.8 to 3.3, Ti: 0.65 to 1.15, Al: 0.2 to 0.8, Co: 1.0 or less, C: 0.08 or less, Mn: 0.35 or less, Si: 0.35 or less, B: 0.006 or less and the balance of Fe and unavoidable impurities; 2-1) an alloy consisting of C: 0.25 or less, Si: 1.0 or less, Mn: 1.0 or less, Cr: 19.0 to 24.0, Co: 15.0 or less, Mo: 8.0 to 10.0, a total of Nb and Ta: 4.15 or less, Al: 1.5 or less, Ti: 0.6 or less, Fe: 20.0 or less, W: 1.0 or less, B: 0.01 or less and the balance of Ni and unavoidable impurities; 3-1) an alloy consisting of C: 0.2 or less, Si: 1.0 or less, Mn: 1.0 or less, Cr: 12.0 to 21.0, Co: 22.0 or less, Mo: 10.5 or less, a total of Nb and Ta: 2.8 or less, Al: 0.4 to 6.5, Ti: 0.5 to 3.25, Fe: 9.0 or less, B: 0.02 or less, Zr: 4.0 or less and the balance of Ni and unavoidable impurities; and 4-1) an alloy consisting of C: 0.45 or less, Si: 1.0 or less, Mn: 2.0 or less, Cr: 19.0 to 25.0, Ni: 18.0 to 45.0, Mo: 2.0 or less, Nb: 0.1 to 0.4, W: 8.0 or less, Ti: 0.6 or less, Al: 0.6 or less, B: 0.01 or less, N: 0.25 or less and the balance of Fe and unavoidable impurities; and a casing of the high-temperature, intermediate-pressure turbine is formed of, on percentage by weight basis, one alloy selected from a group consisting of 1-2) to 4-2): 1-2) an alloy consisting of Ni: 50.0 to 55.0, Cr: 17.0 to 21.0, a total of Nb or Nb and Ta: 4.75 to 5.5, Mo: 2.8 to 3.3, Ti: 0.65 to 1.15, Al: 0.2 to 0.8, Co: 1.0 or less, C: 0.08 or less, Mn: 0.35 or less, Si: 0.35 or less, B: 0.006 or less and the balance of Fe and unavoidable impurities; 2-2) an alloy consisting of C: 0.25 or less, Si: 1.0 or less, Mn: 1.0 or less, Cr: 19.0 to 24.0, Co: 15.0 or less, Mo: 8.0 to 10.0, a total of Nb and Ta: 4.15 or less, Al: 1.5 or less, Ti: 0.6 or less, Fe: 20.0 or less, W: 1.0 or less, B: 0.01 or less and the balance of Ni and unavoidable impurities; 3-2) an alloy consisting of C: 0.2 or less, Si: 1.0 or less, Mn: 1.0 or less, Cr: 12.0 to 21.0, Co: 22.0 or less, Mo: 10.5 or less, a total of Nb and Ta: 2.8 or less, Al: 0.4 to 6.5, Ti: 0.5 to 3.25, Fe: 9.0 or less, B: 0.02 or less, Zr: 4.0 or less and the balance of Ni and unavoidable impurities; and 4-2) an alloy consisting of C: 0.45 or less, Si: 1.0 or less, Mn: 2.0 or less, Cr: 19.0 to 25.0, Ni: 18.0 to 45.0, Mo: 2.0 or less, Nb: 0.1 to 0.4, W: 8.0 or less, Ti: 0.6 or less, Al: 0.6 or less, B: 0.01 or less, N: 0.25 or less and the balance of Fe and unavoidable impurities; and at least a first stage turbine blade of turbine blades constructed of plural stages of the high-temperature, intermediate-pressure turbine is formed of, on percentage by weight basis, one alloy selected from a group consisting of 5-1) to 9-1): 5-1) an alloy consisting of Ni: 50.0 to 55.0, Cr: 17.0 to 21.0, a total of Nb or Nb and Ta: 4.75 to 5.5, Mo: 2.8 to 3.3, Ti: 0.65 to 1.15, Al: 0.2 to 0.8, Co: 1.0 or less, C: 0.08 or less, Mn: 0.35 or less, Si: 0.35 or less, B: 0.006 or less and the balance of Fe and unavoidable impurities; 6-1) an alloy consisting of C: 0.25 or less, Si: 1.0 or less, Mn: 1.0 or less, Cr: 19.0 to 24.0, Co: 15.0 or less, Mo: 8.0 to 10.0, a total of Nb and Ta: 4.15 or less, Al: 1.5 or less, Ti: 0.6 or less, Fe: 20.0 or less, W: 1.0 or less, B: 0.01 or less and the balance of Ni and unavoidable impurities; 7-1) an alloy consisting of C: 0.2 or less, Si: 1.0 or less, Mn: 1.0 or less, Cr: 12.0 to 21.0, Co: 22.0 or less, Mo: 10.5 or less, a total of Nb and Ta: 2.8 or less, Al: 0.4 to 6.5, Ti: 0.5 to 3.25, Fe: 9.0 or less, B: 0.02 or less, Zr: 4.0 or less and the balance of Ni and unavoidable impurities; 8-1) an alloy consisting of C: 0.45 or less, Si: 1.0 or less, Mn: 2.0 or less, Cr: 19.0 to 25.0, Ni: 18.0 to 45.0, Mo: 2.0 or less, Nb: 0.1 to 0.4, W: 8.0 or less, Ti: 0.6 or less, Al: 0.6 or less, B: 0.01 or less, N: 0.25 or less and the balance of Fe and unavoidable impurities; and 9-1) an alloy consisting of C: 0.1 or less, Si: 1.5 or less, Mn: 1.0 or less, Cr: 11.0 to 20.0, a total of Ni and Co: 40.0 to 60.0, Mo: 2.5 to 7.0, Al: 0.35 or less, Ti: 2.3 to 3.1, Zr: 0.1 or less, B: 0.001 to 0.02 and the balance of Fe and unavoidable impurities.

According to those steam turbine power plants, the intermediate-pressure turbine is separated into the high-temperature, intermediate-pressure turbine and the low-temperature, intermediate-pressure turbine, only the component members of the high-temperature, intermediate-pressure turbine are formed of the austenitic alloy steels or the Ni-based alloys, and the ferritic alloy steels are applied to the low-temperature, intermediate-pressure turbine in the same way as before, so that the members which are formed of the austenitic alloy steels and the Ni-based alloys can be reduced to small numbers, and economical efficiency can be assured. By using the high heat-resistant austenitic alloy steels or Ni-based alloys to form the high-temperature, intermediate-pressure turbine, the high-temperature steam of 650° C. or more can be introduced into the high-temperature, intermediate-pressure turbine, and the thermal efficiency can be improved. Besides, for the high-pressure turbine which has the pressure resistant component members configured of relatively thick parts, the main members are formed of the ferritic alloy steels to configure the same high-pressure turbine structure as before. Thus, the reliability, operability and economical efficiency can be assured.

The steam turbine power plant according to another aspect of the present invention is a steam turbine power plant comprising a high-pressure turbine, an intermediate-pressure turbine and a low-pressure turbine, the intermediate-pressure turbine being separated into a high-temperature, intermediate-pressure turbine into which high-temperature steam having steam exhausted from the high-pressure turbine reheated to 650° C. or more is introduced and a low-temperature, intermediate-pressure turbine into which steam exhausted from the high-temperature, intermediate-pressure turbine is introduced, wherein a steam cooling unit for cooling a rotor of the high-temperature, intermediate-pressure turbine by cooling steam is provided, at least one composing element of the high-pressure turbine, the low-temperature, intermediate-pressure turbine and the low-pressure turbine is formed of ferritic alloy steel, and the rotor of the high-temperature, intermediate-pressure turbine is formed of, on percentage by weight basis, one alloy steel selected from a group consisting of 10) to 14): 10) an alloy steel consisting of C: 0.08 to 0.15, Si: 0.1 or less, Mn: 0.1 to 0.3, Ni: 0.1 to 0.3, Cr: 9.0 to less than 10.0, V: 0.15 to 0.3, Mo: 0.6 to 1.0, W: 1.5 to 2.0, Co: 1.0 to 4.0, Nb: 0.02 to 0.08, B: 0.001 to 0.015, N: 0.01 to 0.06 and the balance of Fe and unavoidable impurities and having $M_{23}C_6$ type carbide precipitated mainly on grain boundaries and martensitic lath boundaries by a tempering heat treatment, $M_2X$ type carbonitride and MX type carbonitride precipitated within the martensitic lath, a relationship of V>Mo between V and Mo in the component elements of the $M_2X$ type carbonitride, and a total of precipitates of the $M_{23}C_6$ type carbide, the $M_2X$ type carbonitride and the MX type carbonitride being 2.0 to 4.0% by weight; 11) an alloy steel consisting of C: 0.08 to 0.15, Si: 0.1 or less, Mn: 0.1 to 0.8, Ni: 0.1 to 0.8, Cr: 9.0 to less than 11.0, V: 0.15 to 0.3, Mo: 0.8 to 1.4, Nb: 0.02 to 0.3, N: 0.01 to 0.06 and the balance of Fe and unavoidable impurities; 12) an alloy steel consisting of C: 0.08 to 0.15, Si: 0.1 or less, Mn: 0.1 to 0.8, Ni: 0.1 to 0.8, Cr: 9.0 to less than 11.0, V: 0.15 to 0.3, Mo: 0.8 to 1.4, Nb: 0.02 to 0.3, N: 0.01 to 0.06, W: 0.5 to 1.4 and the balance of Fe and unavoidable impurities; 13) an alloy steel consisting of C: 0.13 to 0.35, Si: 0.2 or less, Mn: 0.8 or less, Ni: 0.8 or less, Cr: 0.8 to 1.9, V: 0.2 to 0.35, Ti: 0.01 or less, Mo: 0.7 to 1.4 and the balance of Fe and unavoidable impurities; and 14) an alloy steel consisting of C: 0.13 to 0.35, Si: 0.2 or less, Mn: 0.8 or less, Ni: 0.8 or less, Cr: 0.8 to 1.9, V: 0.2 to 0.35, Ti: 0.01 or less, Mo: 0.7 to 1.4, W: 0.8 to 1.4 and the balance of Fe and unavoidable impurities.

According to this steam turbine power plant, the high-temperature, intermediate-pressure turbine is provided with the steam cooling unit for cooling the rotor by the cooling steam. Therefore, the rotor can be formed of the same ferritic alloy steels as before, even if the high-temperature steam of 650° C. or more is introduced into the high-temperature, intermediate-pressure turbine and the thermal efficiency can be improved and the economical efficiency can be assured. The alloy steel described in 10) above is used for the steam turbine and has a property that the metallic compounds of the $M_{23}C_6$ type carbide, $M_2X$ type carbonitride and MX type carbonitride precipitate during its operation, and the total of precipitates initially contained is 2.0 to 4.0% by weight but a total of precipitates becomes 4.0 to 6.0% by weight after the alloy steel is used for the high-temperature, intermediate-pressure turbine. And, the desired mechanical properties can be obtained because this alloy steel is configured in such a manner that the specified types of precipitates, metallographical precipitated positions and their precipitated amounts and component element ratio are satisfied.

Besides, the steam turbine power plant according to another aspect of the present invention is a steam turbine power plant comprising a high-pressure turbine, an intermediate-pressure turbine into which high-temperature steam having steam exhausted from the high-pressure turbine reheated to 650° C. or more is introduced and a low-pressure turbine into which steam exhausted from the intermediate-pressure turbine is introduced, wherein at least one composing element of the high-pressure turbine and the low-pressure turbine is formed of ferritic alloy steel, and a rotor and a casing of the intermediate-pressure turbine are formed of, on percentage by weight basis, one alloy selected from a group consisting of 30) to 33): 30) an alloy consisting of Ni: 50.0 to 55.0, Cr: 17.0 to 21.0, a total of Nb or Nb and Ta: 4.75 to 5.5, Mo: 2.8 to 3.3, Ti: 0.65 to 1.15, Al: 0.2 to 0.8, Co: 1.0 or less, C: 0.08 or less, Mn: 0.35 or less, Si: 0.35 or less, B: 0.006 or less and the balance of Fe and unavoidable impurities; 31) an alloy consisting of C: 0.25 or less, Si: 1.0 or less, Mn: 1.0 or less, Cr: 19.0 to 24.0, Co: 15.0 or less, Mo: 8.0 to 10.0, total of Nb and Ta: 4.15 or less, Al: 1.5 or less, Ti: 0.6 or less, Fe: 20.0 or less, W: 1.0 or less, B: 0.01 or less and the balance of Ni and unavoidable impurities; 32) an alloy consisting of C: 0.2 or less, Si: 1.0 or less, Mn: 1.0 or less, Cr: 12.0 to 21.0, Co: 22.0 or less, Mo: 10.5 or less, a total of Nb and Ta: 2.8 or less, Al: 0.4 to 6.5, Ti: 0.5 to 3.25, Fe: 9.0 or less, B: 0.02 or less, Zr: 4.0 or less and the balance of Ni and unavoidable impurities; and 33) an alloy consisting of C: 0.45 or less, Si: 1.0 or less, Mn: 2.0 or less, Cr: 19.0 to 25.0, Ni: 18.0 to 45.0, Mo: 2.0 or less, Nb: 0.1 to 0.4, W: 8.0 or less, Ti: 0.6 or less, Al: 0.6 or less, B: 0.01 or less, N: 0.25 or less and the balance of Fe and unavoidable impurities; and at least a first stage turbine blade of turbine blades constructed of plural stages of the intermediate-pressure turbine is formed of, on percentage by weight basis, one alloy selected from a group consisting of 34) to 38): 34) an alloy consisting of Ni: 50.0 to 55.0, Cr: 17.0 to 21.0, a total of Nb or Nb and Ta: 4.75 to 5.5, Mo: 2.8 to 3.3, Ti: 0.65 to 1.15, Al: 0.2 to 0.8, Co: 1.0 or less, C: 0.08 or less, Mn: 0.35 or less, Si: 0.35 or less, B: 0.006 or less and the balance of Fe and unavoidable impurities; 35) an alloy consisting of C: 0.25 or less, Si: 1.0 or less, Mn: 1.0 or less, Cr: 19.0 to 24.0, Co: 15.0 or less, Mo: 8.0 to 10.0, a total of Nb and Ta: 4.15 or less, Al: 1.5 or less, Ti: 0.6 or less, Fe: 20.0 or less, W: 1.0 or less, B: 0.01 or less and the balance of Ni and unavoidable impurities; 36) an alloy consisting of C: 0.2 or less, Si: 1.0 or less, Mn: 1.0 or less, Cr: 12.0 to 21.0, Co: 22.0 or less, Mo: 10.5 or less, a total of Nb and Ta: 2.8 or less, Al: 0.4 to 6.5, Ti: 0.5 to 3.25, Fe: 9.0 or less, B: 0.02 or less, Zr: 4.0 or less and the balance of Ni and unavoidable impurities; 37) an alloy consisting of C: 0.45 or less, Si: 1.0 or less, Mn: 2.0 or less, Cr: 19.0 to 25.0, Ni: 18.0 to 45.0, Mo: 2.0 or less, Nb: 0.1 to 0.4, W: 8.0 or less, Ti: 0.6 or less, Al: 0.6 or less, B: 0.01 or less, N: 0.25 or less and the balance of Fe and unavoidable impurities; and 38) an alloy consisting of C: 0.1 or less, Si: 1.5 or less, Mn: 1.0 or less, Cr: 11.0 to 20.0, a total of Ni and Co: 40.0 to 60.0, Mo: 2.5 to 7.0, Al: 0.35 or less, Ti: 2.3 to 3.1, Zr: 0.1 or less, B: 0.001 to 0.02 and the balance of Fe and unavoidable impurities.

The steam turbine power plant according to another aspect of the present invention is a steam turbine power plant comprising a high-pressure turbine, an intermediate-pressure turbine into which high-temperature steam having steam exhausted from the high-pressure turbine reheated to 650° C. or more is introduced, and a low-pressure turbine into which steam exhausted from the intermediate-pressure turbine is introduced, wherein at least one composing element of the high-pressure turbine and the low-pressure turbine is formed of ferritic alloy steel, and a rotor of the intermediate-pressure turbine is formed of plural components, and the individual components are formed of, on percentage by weight basis, any alloy selected from a group consisting of 30-1) to 33-1): 30-1) an alloy consisting of Ni: 50.0 to 55.0, Cr: 17.0 to 21.0, a total of Nb or Nb and Ta: 4.75 to 5.5, Mo: 2.8 to 3.3, Ti: 0.65 to 1.15, Al: 0.2 to 0.8, Co: 1.0 or less, C: 0.08 or less, Mn: 0.35 or less, Si: 0.35 or less, B: 0.006 or less and the balance of Fe and unavoidable impurities; 31-1) an alloy consisting of C: 0.25 or less, Si: 1.0 or less, Mn: 1.0 or less, Cr: 19.0 to 24.0, Co: 15.0 or less, Mo: 8.0 to 10.0, a total of Nb and Ta: 4.15 or less, Al: 1.5 or less, Ti: 0.6 or less, Fe: 20.0 or less, W: 1.0 or less, B: 0.01 or less and the balance of Ni and unavoidable impurities; 32-1) an alloy consisting of C: 0.2 or less, Si: 1.0 or less, Mn: 1.0 or less, Cr: 12.0 to 21.0, Co: 22.0 or less, Mo: 10.5 or less, a total of Nb and Ta: 2.8 or less, Al: 0.4 to 6.5, Ti: 0.5 to 3.25, Fe: 9.0 or less, B: 0.02 or less, Zr: 4.0 or less and the balance of Ni and unavoidable impurities; and 33-1) an alloy consisting of C: 0.45 or less, Si: 1.0 or less, Mn: 2.0 or less, Cr: 19.0 to 25.0, Ni: 18.0 to 45.0, Mo: 2.0 or less, Nb: 0.1 to 0.4, W: 8.0 or less, Ti: 0.6 or less, Al: 0.6 or less, B: 0.01 or less, N: 0.25 or less and the balance of Fe and unavoidable impurities; and a casing of the intermediate-pressure turbine is formed of, on percentage by weight basis, one alloy selected from a group consisting of 30-2) to 33-2): 30-2) an alloy consisting of Ni: 50.0 to 55.0, Cr: 17.0 to 21.0, a total of Nb or Nb and Ta: 4.75 to 5.5, Mo: 2.8 to 3.3, Ti: 0.65 to 1.15, Al: 0.2 to 0.8, Co: 1.0 or less, C: 0.08 or less, Mn: 0.35 or less, Si: 0.35 or less, B: 0.006 or less and the balance of Fe and unavoidable impurities; 31-2) an alloy consisting of C: 0.25 or less, Si: 1.0 or less, Mn: 1.0 or less, Cr: 19.0 to 24.0, Co: 15.0 or less, Mo: 8.0 to 10.0, a total of Nb and Ta: 4.15 or less, Al: 1.5 or less, Ti: 0.6 or less, Fe: 20.0 or less, W: 1.0 or less, B: 0.01 or less and the balance of Ni and unavoidable impurities; 32-2) an alloy consisting of C: 0.2 or less, Si: 1.0 or less, Mn: 1.0 or less, Cr: 12.0 to 21.0, Co: 22.0 or less, Mo: 10.5 or less, a total of Nb and Ta: 2.8 or less, Al: 0.4 to 6.5, Ti: 0.5 to 3.25, Fe: 9.0 or less, B: 0.02 or less, Zr: 4.0 or less and the balance of Ni and unavoidable impurities; and 33-2) an alloy consisting of C: 0.45 or less, Si: 1.0 or less, Mn: 2.0 or less, Cr: 19.0 to 25.0, Ni: 18.0 to 45.0, Mo: 2.0 or less, Nb: 0.1 to 0.4, W: 8.0 or less, Ti: 0.6 or less, Al: 0.6 or less, B: 0.01 or less, N: 0.25 or less and the balance of Fe and unavoidable impurities; and at least a first stage turbine blade of turbine blades constructed of plural stages of the intermediate-pressure turbine is formed of, on percentage by weight basis, one alloy selected from a group consisting of 34-1) to 38-1): 34-1) an alloy consisting of Ni: 50.0 to 55.0, Cr: 17.0 to 21.0, a total of Nb or Nb and Ta: 4.75 to 5.5, Mo: 2.8 to 3.3, Ti: 0.65 to 1.15, Al: 0.2 to 0.8, Co: 1.0 or less, C: 0.08 or less, Mn: 0.35 or less, Si: 0.35 or less, B: 0.006 or less and the balance of Fe and unavoidable impurities; 35-1) an alloy consisting of C: 0.25 or less, Si: 1.0 or less, Mn: 1.0 or less, Cr: 19.0 to 24.0, Co: 15.0 or less, Mo: 8.0 to 10.0, a total of Nb and Ta: 4.15 or less, Al: 1.5 or less, Ti: 0.6 or less, Fe: 20.0 or less, W: 1.0 or less, B: 0.01 or less and the balance of Ni and unavoidable impurities; 36-1) an alloy consisting of C: 0.2 or less, Si: 1.0 or less, Mn: 1.0 or less, Cr: 12.0 to 21.0, Co: 22.0 or less, Mo: 10.5 or less, a total of Nb and Ta: 2.8 or less, Al: 0.4 to 6.5, Ti: 0.5 to 3.25, Fe: 9.0 or less, B: 0.02 or less, Zr: 4.0 or less and the balance of Ni and unavoidable impurities; 37-1) an alloy consisting of C: 0.45 or less, Si: 1.0 or less, Mn: 2.0 or less, Cr: 19.0 to 25.0, Ni: 18.0 to 45.0, Mo: 2.0 or less, Nb: 0.1 to 0.4, W: 8.0 or less, Ti: 0.6 or less, Al: 0.6 or less, B: 0.01 or less, N: 0.25 or less and the balance of Fe and unavoidable impurities; and 38-1) an alloy consisting of C: 0.1 or less, Si: 1.5 or less, Mn: 1.0 or less, Cr: 11.0 to 20.0, a total of Ni and Co: 40.0 to 60.0, Mo: 2.5 to 7.0, Al: 0.35 or less, Ti: 2.3 to 3.1, Zr: 0.1 or less, B: 0.001 to 0.02 and the balance of Fe and unavoidable impurities.

According to those steam turbine power plants, the high-pressure turbine having the pressure resistant component members formed of relatively thick parts has the main members formed of the ferritic alloy steels to configure the same high-pressure turbine structure as before, so that the reliability, operability and economical efficiency can be assured. And, the intermediate-pressure turbine is formed of the high heat-resistant austenitic based alloy steels or the Ni-based alloys, so that the high-temperature steam of 650° C. or more can be introduced into the high-temperature, intermediate-pressure turbine, and the thermal efficiency can be improved.

The steam turbine power plant according to another aspect of the present invention is a steam turbine power plant comprising a high-pressure turbine, an intermediate-pressure turbine into which high-temperature steam having steam exhausted from the high-pressure turbine reheated to 650° C. or more is introduced, and a low-pressure turbine into which steam exhausted from the intermediate-pressure turbine is introduced, wherein a steam cooling unit for cooling a rotor of the intermediate-pressure turbine by cooling steam is provided, at least one composing element of the high-pressure turbine and the low-pressure turbine is formed of ferritic alloy steel, and the rotor of the intermediate-pressure turbine is formed of, on percentage by weight basis, one alloy steel selected from a group consisting of 39) to 43): 39) an alloy steel consisting of C: 0.08 to 0.15, Si: 0.1 or less, Mn: 0.1 to 0.3, Ni: 0.1 to 0.3, Cr: 9.0 to less than 10.0, V: 0.15 to 0.3, Mo: 0.6 to 1.0, W: 1.5 to 2.0, Co: 1.0 to 4.0, Nb: 0.02 to 0.08, B: 0.001 to 0.015, N: 0.01 to 0.06 and the balance of Fe and unavoidable impurities and having $M_{23}C_6$ type carbide precipitated mainly on grain boundaries and martensitic lath boundaries by a tempering heat treatment, $M_2X$ type carbonitride and MX type carbonitride precipitated within the martensitic lath, a relationship of V>Mo between V and Mo in the component elements of the $M_2X$ type carbonitride, and a total of precipitates of the $M_{23}C_6$ type carbide, the $M_2X$ type carbonitride and the MX type carbonitride being 2.0 to 4.0% by weight; 40) an alloy steel consisting of C: 0.08 to 0.15, Si: 0.1 or less, Mn: 0.1 to 0.8, Ni: 0.1 to 0.8, Cr: 9.0 to less than 11.0, V: 0.15 to 0.3, Mo: 0.8 to 1.4, Nb: 0.02 to 0.3, N: 0.01 to 0.06 and the balance of Fe and unavoidable impurities; 41) an alloy steel consisting of C: 0.08 to 0.15, Si: 0.1 or less, Mn: 0.1 to 0.8, Ni: 0.1 to 0.8, Cr: 9.0 to less than 11.0, V: 0.15 to 0.3, Mo: 0.8 to 1.4, Nb: 0.02 to 0.3, N: 0.01 to 0.06, W: 0.5 to 1.4 and the balance of Fe and unavoidable impurities; 42) an alloy steel consisting of C: 0.13 to 0.35, Si: 0.2 or less, Mn: 0.8 or less, Ni: 0.8 or less, Cr: 0.8 to 1.9, V: 0.2 to 0.35, Ti: 0.01 or less, Mo: 0.7 to 1.4 and the balance of Fe and unavoidable impurities; and 43) an alloy steel consisting of C: 0.13 to 0.35, Si: 0.2 or less, Mn: 0.8 or less, Ni: 0.8 or less, Cr: 0.8 to 1.9, V: 0.2 to 0.35, Ti: 0.01 or less, Mo: 0.7 to 1.4, W: 0.8 to 1.4 and the balance of Fe and unavoidable impurities.

According to this steam turbine power plant, the intermediate-pressure turbine is provided with the steam cooling unit for cooling the rotor by the cooling steam. Therefore, the rotor can be formed of the same ferritic alloy steels as before and the thermal efficiency can be improved even if the high-temperature steam of 650° C. or more is introduced into the intermediate-pressure turbine and the economical efficiency can be assured. The alloy steel described in 39) above is used for the steam turbine and has a property that the metallic compounds of the $M_{23}C_6$ type carbide, $M_2X$ type carbonitride and MX type carbonitride precipitate during its operation, and the total of precipitates initially contained is 2.0 to 4.0% by weight but a total of precipitates becomes 4.0 to 6.0% by weight after the alloy steel is used for the high-temperature, intermediate-pressure turbine. And, the desired mechanical properties can be obtained because this alloy steel is configured in such a manner that the specified types of precipitates, metallographical precipitated positions and their precipitated amounts and component element ratio are satisfied.

BRIEF DESCRIPTION OF THE DRAWINGS

The present invention will be described with reference to the drawings, but it is to be understood that the drawings are provided for illustration only and the invention is not limited to the drawings.

DETAILED DESCRIPTION OF THE INVENTION

Figure 1:
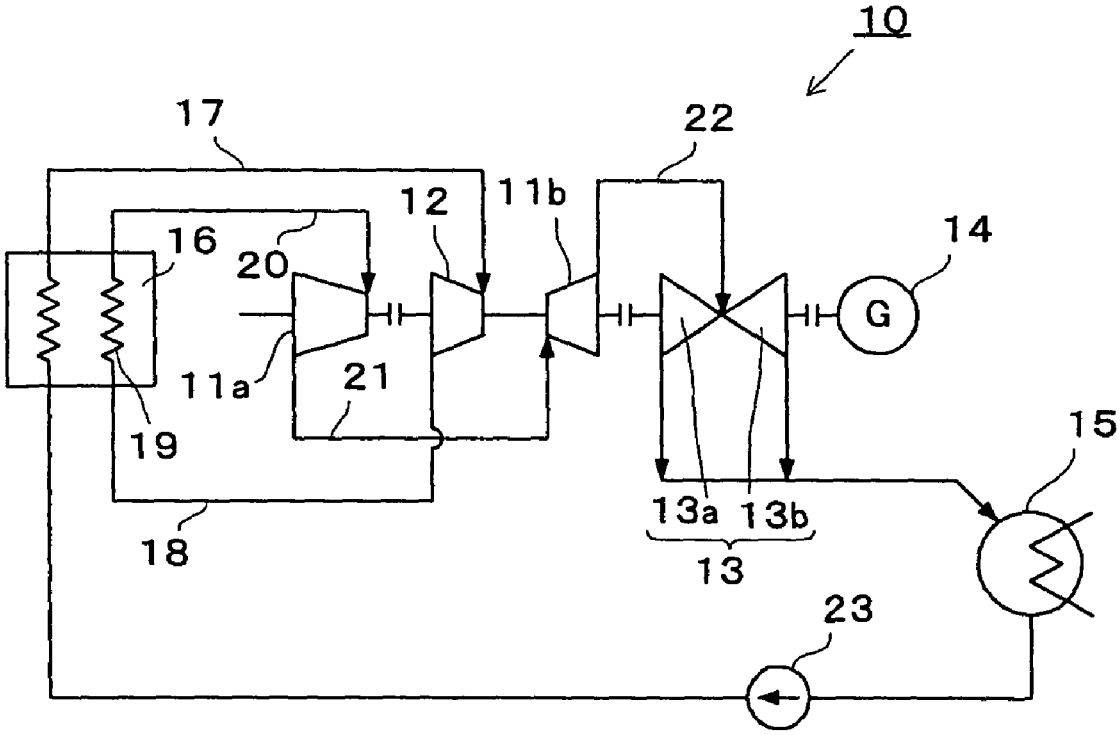
FIG. 1 is a diagram showing an overview of the structure of the steam turbine power plant according to a first embodiment of the present invention.

One embodiment of the present invention will be described with reference to the drawings.

A heat-resistant alloy or heat-resistant alloy steel forming the component members of the steam turbine of the present invention will be described. The heat-resistant alloy or the heat-resistant alloy steel forming the component members of the steam turbine of the invention is appropriately selected from the heat-resistant alloys or the heat-resistant alloy steels falling in a range of chemical compositions of (M1) to (M14) shown below depending on conditions. The ratios of the chemical compositions shown below are indicated on percentage by weight basis.

(M1) an alloy consisting of Ni: 50.0 to 55.0, Cr: 17.0 to 21.0, a total of Nb or Nb and Ta: 4.75 to 5.5, Mo: 2.8 to 3.3, Ti: 0.65 to 1.15, Al: 0.2 to 0.8, Co: 1.0 or less (0 included), C: 0.08 or less (0 not included) Mn: 0.35 or less (0 not included), Si: 0.35 or less (0 not included), B: 0.006 or less (0 not included), and the balance of Fe and unavoidable impurities.

If the Co content is "0", Fe or Ni may be used instead in a range of the Co content.

(M2) an alloy consisting of C: 0.02-0.25, Si: 1.0 or less (0 not included), Mn: 1.0 or less (0 not included), Cr: 19.0 to 24.0, Co: 15.0 or less (0 included), Mo: 8.0 to 10.0, a total of Nb and Ta: 4.15 or less (0 included), Al: 1.5 or less (0 included), Ti: 0.6 or less (0 included), Fe: 20.0 or less (0 not included), W: 1.0 or less (0 included), B: 0.01 or less (0 included) and the balance of Ni and unavoidable impurities.

If the Co content is "0", a total amount of Nb and Ta is increased within the range of the above-described content to assure satisfactory mechanical properties. If the Nb and Ta contents are "0" (a total of Nb and Ta is "0"), at least one element among Co, B, Ti, Al and Fe is increased within the above-described content of each ingredient to assure the satisfactory mechanical properties. If the content of Al and/or Ti is "0", at least one of W, Co and Fe is increased within the range of the above-described content of each ingredient to assure the satisfactory mechanical properties. Besides, if the W content is "0", at least one of Nb, Ta and B is increased within the range of the above-described content of each ingredient to assure the satisfactory mechanical properties. If the B content is "0", at least one of W, Nb, Ta and Fe is increased within the range of the above-described content of each ingredient to assure the satisfactory mechanical properties.

(M3) An alloy consisting of C: 0.02 to 0.2, Si: 1.0 or less (0 not included), Mn: 1.0 or less (0 not included), Cr: 12.0 to 21.0, Co: 22.0 or less (0 included), Mo: 10.5 or less (0 included), a total of Nb and Ta: 2.8 or less (0 included), Al: 0.4 to 6.5, Ti: 0.5 to 3.25, Fe: 9.0 or less (0 included), B: 0.02 or less (0 included), Zr: 4.0 or less (0 included) and the balance of Ni and unavoidable impurities.

If the Co content is "0", at least one of Ti, Al, Nb, Ta and Fe is increased within the range of the above-described content of each component to assure the satisfactory mechanical properties. If the Mo content is "0", at least one of Co, Nb and Ta is increased in the range of the above-described content of each component to assure the satisfactory mechanical properties. If the Nb and Ta contents are "0" (a total of Nb and Ta is "0"), at least one of Co, B and Zr is increased within the range of the above-described content of each component to assure the satisfactory mechanical properties. Besides, if the Fe content is "0", Co is increased in the range of the above-described Co content to assure the satisfactory mechanical properties. If the B content is "0", at least one of Nb, Ta, Co and Fe is increased within the above-described content of each component to assure the satisfactory mechanical properties. If the Zr content is "0", at least one of Co, Mo, Nb and Ta is increased within the above-described content of each component to assure the satisfactory mechanical properties.

(M4) an alloy steel consisting of C: 0.08 to 0.15, Si: 0.1 or less (0 not included), Mn: 0.1 to 0.3, Ni: 0.1 to 0.3, Cr: 9.0 to less than 10.0, V: 0.15 to 0.3, Mo: 0.6 to 1.0, W: 1.5 to 2.0, Co: 1.0 to 4.0, Nb: 0.02 to 0.08, B: 0.001 to 0.015, N: 0.01 to 0.06 and the balance of Fe and unavoidable impurities and having $M_{23}C_6$ type carbide precipitated mainly on grain boundaries and martensitic lath boundaries by a tempering heat treatment, $M_2X$ type carbonitride and MX type carbonitride precipitated within the martensitic lath, a relationship of V>Mo between V and Mo in the component elements of the $M_2X$ type carbonitride, and a total of precipitates of the $M_{23}C_6$ type carbide, the $M_2X$ type carbonitride and the MX type carbonitride being 2.0 to 4.0% by weight.

(M5) an alloy steel consisting of C: 0.08 to 0.15, Si: 0.1 or less (0 not included), Mn: 0.1 to 0.8, Ni: 0.1 to 0.8, Cr: 9.0 to less than 11.0, V: 0.15 to 0.3, Mo: 0.8 to 1.4, Nb: 0.02 to 0.3, N: 0.01 to 0.06 and the balance of Fe and unavoidable impurities.

(M6) an alloy steel consisting of C: 0.08 to 0.15, Si: 0.1 or less (0 not included), Mn: 0.1 to 0.8, Ni: 0.1 to 0.8, Cr: 9.0 to less than 11.0, V: 0.15 to 0.3, Mo: 0.8 to 1.4, Nb: 0.02 to 0.3, N: 0.01 to 0.06, W: 0.5 to 1.4 and the balance of Fe and unavoidable impurities.

(M7) an alloy steel consisting of C: 0.13 to 0.35, Si: 0.2 or less (0 not included), Mn: 0.8 or less (0 not included), Ni: 0.8 or less (0 not included), Cr: 0.8 to 1.9, V: 0.2 to 0.35, Ti: 0.01 or less (0 included), Mo: 0.7 to 1.4 and the balance of Fe and unavoidable impurities.

If the Ti content is "0", V is increased within the range of the above-described V content to assure the satisfactory mechanical properties.

(M8) an alloy steel consisting of C: 0.13 to 0.35, Si: 0.2 or less (0 not included), Mn: 0.8 or less (0 not included), Ni: 0.8 or less (0 not included), Cr: 0.8 to 1.9, V: 0.2 to 0.35, Ti: 0.01 or less (0 included), Mo: 0.7 to 1.4, W: 0.8 to 1.4 and the balance of Fe and unavoidable impurities.

If the Ti content is "0", V is increased within the range of the above-described V content to assure the satisfactory mechanical properties.

(M9) an alloy consisting of C: 0.1 or less (0 not included), Si: 1.5 or less (0 not included), Mn: 1.0 or less (0 not included), Cr: 11.0 to 20.0, a total of Ni and Co: 40.0 to 60.0, Mo: 2.5 to 7.0, Al: 0.35 or less (0 not included), Ti: 2.3 to 3.1, Zr: 0.1 or less (0 not included), B: 0.001 to 0.02 and the balance of Fe and unavoidable impurities.

(M10) an alloy consisting of C: 0.05 to 0.45, Si: 2.0 or less (0 not included), Mn: 2.0 or less (0 not included), Cr: 23.0 to 27.0, Ni: 18.0 to 22.0, Mo: 0.5 or less (0 included) and the balance of Fe and unavoidable impurities.

If the Mo content is "0", C is increased within the range of the above-described C content to assure the satisfactory mechanical properties.

(M11) an alloy steel consisting of C: 0.05 to 0.15, Si: 0.3 or less (0 not included), Mn: 0.1 to 1.5, Ni: 1.0 or less (0 not included), Cr: 9.0 to less than 10, V: 0.1 to 0.3, Mo: 0.6 to 1.0, W: 1.5 to 2.0, Co: 1.0 to 4.0, Nb: 0.02 to 0.08, B: 0.001 to 0.008, N: 0.005 to 0.1, Ti: 0.001 to 0.03 and the balance of Fe and unavoidable impurities and having $M_{23}C_6$ type carbide precipitated mainly on grain boundaries and martensitic lath boundaries by a tempering heat treatment, $M_2X$ type carbonitride and MX type carbonitride precipitated within the martensitic lath, a relationship of V>Mo between V and Mo in the component elements of the $M_2X$ type carbonitride, and a total of precipitates of the $M_{23}C_6$ type carbide, the $M_2X$ type carbonitride and the MX type carbonitride being 2.0 to 4.0% by weight.

(M12) an alloy steel consisting of C: 0.05 to 0.16, Si: 0.3 or less (0 not included), Mn: 0.5 to 0.7, Ni: 0.3 to 0.6, Cr: 9.0 to 10.5, V: 0.1 to 0.3, Mo: 0.6 to 1.0, Nb: 0.02 to 0.08, N: 0.005 to 0.1 and the balance of Fe and unavoidable impurities.

(M13) an alloy steel consisting of C: 0.12 to 0.18, Si: 0.3 or less (0 not included), Mn: 0.5 to 0.9, Ni: 0.5 or less (0 not included), Cr: 1.0 to 1.5, V: 0.2 to 0.35, Mo: 0.9 to 1.2, Ti: 0.01 to 0.04 and the balance of Fe and unavoidable impurities.

(M14) an alloy consisting of C: 0.01 to 0.45, Si: 1.0 or less (0 not included), Mn: 2.0 or less (0 not included), Cr: 19.0 to 25.0, Ni: 18.0 to 45.0, Mo: 2.0 or less (0 included), Nb: 0.1 to 0.4, W: 8.0 or less (0 included), Ti: 0.6 or less (0 included), Al: 0.6 or less (0 included), B: 0.01 or less (0 included), N: 0.25 or less (0 included) and the balance of Fe and unavoidable impurities.

If the Mo content is "0", W is increased within the range of the above-described W content to assure the satisfactory mechanical properties. If the W content is "0", Mo is increased within the range of the above-described Mo content to assure the satisfactory mechanical properties. If the Ti content is "0", Nb is contained in the range of 0.1 to 0.4% by weight to assure the satisfactory mechanical properties. Besides, if the Al content is "0", Si is increased in the range of the above-described Si content to assure satisfactory environmental resistance. If the B content is "0", W is increased within the range of the above-described W content to assure the satisfactory mechanical properties. If the N content is "0", W is increased within the range of the above-described W content to assure the satisfactory mechanical properties.

Among the heat-resistant alloys or heat-resistant alloy steels of the above-described (M1) to (M14), the desired mechanical properties can be obtained if a material is configured satisfying the types of precipitates, metallographical precipitated positions, their precipitated amounts and component element ratio specified by the materials of (M4) and (M11).

For example, the heat-resistant alloy of (M1) excelling in high-temperature strength and the heat-resistant alloy of (M2) excelling in thermal stability at a high temperature are suitable as a material for the rotor which is formed of relatively small members by combining disks with a shaft. As a material for the rotor, the heat-resistant alloys of (M3) and (M4) excelling in high-temperature strength can also be used. As a material for the rotor provided with a steam cooling unit for cooling the rotor by cooling steam, for example, the heat-resistant alloy steels of (M4) to (M8) which are ferritic heat-resistant steels and have outstanding productivity are suitable.

As a material for buckets, nozzles and stationary blades which are formed of relatively small members and are exposed to high-temperature steam, for example, the heat-resistant alloys of (M3) and (M9), which contain Ti or Al in a large amount, exercise strengthening of γ' phase precipitation in a large amount and excel in high-temperature strength, are suitable. And, the heat-resistant alloys of (M1), (M2) and (M14) excelling in thermal stability at a high temperature can also be used as a material for the buckets, nozzles and stationary blades.

As a material for the casing of the steam turbine provided with a steam cooling unit for cooling the casing by cooling steam, for example, the heat-resistant alloy steels of (M11) to (M13) which are ferritic heat-resistant steels and excel in productivity such as casting are suitable. And, if the casing is not to be cooled, for example, the heat-resistant alloys of (M1), (M2), (M3) and (M14) excelling in thermal stability at a high temperature are suitable.

A welded structure is essential for a nozzle box, which is disposed within the casing to guide the high-temperature steam to a first stage movable blade and exposed to the high-temperature steam. Therefore, for example, the heat-resistant alloys of (M2) and (M14) excelling in thermal stability at a high temperature are suitable as materials for the nozzle box.

A lead pipe, which guides the high-temperature steam to the steam turbine, is exposed to the high-temperature steam. Therefore, as a material for the lead pipe, for example, the heat-resistant alloys of (M2), (M10) and (M14) excelling in thermal stability at a high temperature are suitable.

First Embodiment

A steam turbine power plant 10 according to the first embodiment of the present invention will be described with reference to FIG. 1. FIG. 1 shows an overview of the structure of the steam turbine power plant 10.

The steam turbine power plant 10 has the intermediate-pressure turbine separated into a high-temperature, high-pressure side high-temperature, intermediate-pressure turbine section 11*a* and a low-temperature, low-pressure side low-temperature, intermediate-pressure turbine section 11*b*. This steam turbine power plant 10 is mainly comprised of a high-pressure turbine 12 and the low-temperature, intermediate-pressure turbine section 11*b* which are disposed within the same casing, the high-temperature, intermediate-pressure turbine section 11*a*, a low-pressure turbine 13, a generator 14, a condenser 15, and a boiler 16. The high-temperature, intermediate-pressure turbine section 11*a* into which high-temperature steam having a temperature of 650° C. or more is introduced is formed of austenitic heat-resistant steels or an Ni-based alloys.

A work of steam in the steam turbine power plant 10 will be described.

Steam, which is heated to a temperature lower than 650° C., for example, 630° C., by and flows out of the boiler 16, flows through a main steam pipe 17 to enter the high-pressure turbine 12 at a pressure of 250 ata. When it is assumed that the buckets of the high-pressure turbine 12 are configured of, for example, nine stages, the steam performs a work of expansion in the high-pressure turbine 12, is exhausted through a ninth stage outlet at a steam temperature of 420° C. and a pressure of 70 ata, and flows through a cold reheat pipe 18 to enter a reheater 19. The reheater 19 reheats the entered steam to a temperature of 650° C. or more, for example, 700° C. The reheated steam flows through a hot reheat pipe 20 which functions as a lead pipe to enter the high-temperature, intermediate-pressure turbine section 11*a* at a pressure of 55 ata.

For example, when it is assumed that the buckets of the high-temperature, intermediate-pressure turbine section 11*a* are configured of four stages, the steam, which has flown into the high-temperature, intermediate-pressure turbine section 11*a* and performed a work of expansion, is exhausted through a fourth stage outlet. The exhausted steam is supplied at, for example, a steam temperature of 550° C. and a pressure of 24 ata to the low-temperature, intermediate-pressure turbine section 11*b* through an intermediate pressure section-connecting pipe 21.

The low-temperature, intermediate-pressure turbine section 11*b* is configured of, for example, four stages. The steam, which has flown into the low-temperature, intermediate-pressure turbine section 11*b* and performed a work of expansion, is supplied at, for example, a steam temperature of 360° C. and a pressure of 7 ata, to the low-pressure turbine 13 through a crossover pipe 22.

In the low-pressure turbine 13, two low-pressure turbine sections 13*a*, 13*b* having the same structure are mutually connected tandem. The buckets of the individual low-pressure turbine sections 13*a*, 13*b* have four stages, and the low-pressure turbine section 13*a* and the low-pressure turbine section 13*b* are configured substantially symmetrically. The steam supplied to the low-pressure turbine 13 performs a work of expansion, and is condensed by the condenser 15, pressurized by a boiler feed pump 23 and flown back to the boiler 16. The condensed water flown back to the boiler 16 becomes steam and supplied again to the high-pressure turbine 12 through the main steam pipe 17. The generator 14 is driven to rotate by the work of expansion performed by the individual steam turbines to generate electricity.

Then, the high-temperature, intermediate-pressure turbine section 11*a* will be described with reference to FIG. 2.

Figure 2:
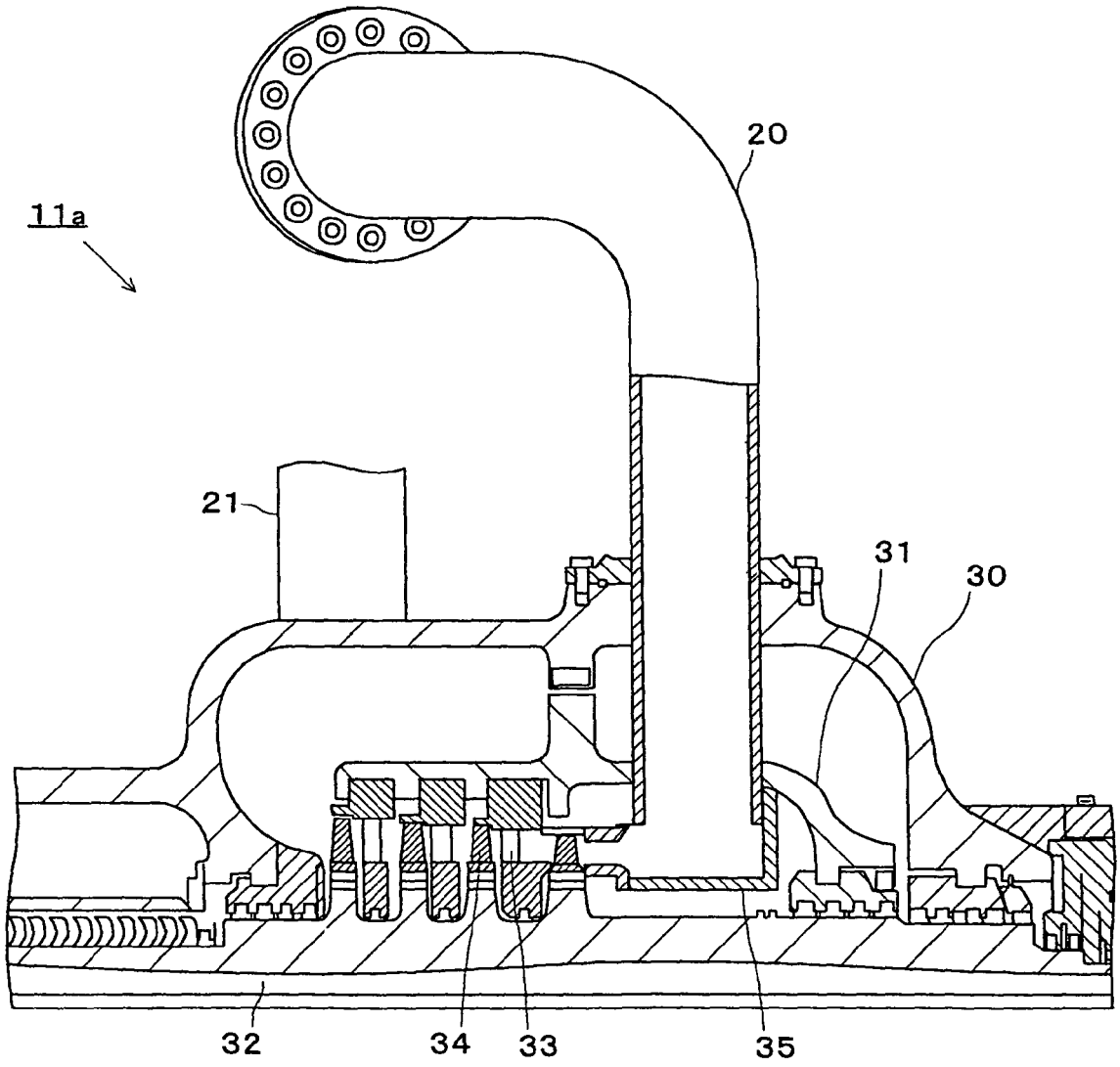
FIG. 2 is a sectional view of the upper half casing section of a high-temperature, intermediate-pressure turbine section.

FIG. 2 shows a sectional view of the upper half casing portion of the high-temperature, intermediate-pressure turbine section 11*a*.

In the high-temperature, intermediate-pressure turbine section 11*a*, an inner casing 31 is disposed within an outer casing 30, and a rotor 32 is disposed to penetrate into the inner casing 31. Nozzles 33 of, for example, three stages, are disposed on the inner sidewall of the inner casing 31, and buckets 34 are implanted in the rotor 32. Besides, the hot reheat pipe 20 is disposed on the high-temperature, intermediate-pressure turbine section 11*a* through the outer casing 30 and the inner casing 31. Besides, an end of the hot reheat pipe 20 is connected in a row with a nozzle box 35 which guides the steam toward the buckets 34.

Subsequently, a work of steam in the high-temperature, intermediate-pressure turbine section 11*a* will be described.

The steam heated to a temperature of 650° C. or more, for example, 700° C., by the reheater 19 flows at a pressure of 55 ata to enter the nozzle box 35 in the high-temperature, intermediate-pressure turbine section 11*a* through the hot reheat pipe 20. The steam having entered the nozzle box 35 is guided to the nozzles 33 and the buckets 34, performs a work of expansion, and is supplied to the low-temperature, intermediate-pressure turbine section 11*b* through the intermediate pressure section-connecting pipe 21.

Then, the component materials of the rotor 32, the buckets 34, the inner casing 31, the outer casing 30, the nozzle box 35 and the hot reheat pipe 20 configuring the high-temperature, intermediate-pressure turbine section 11*a* will be described with reference to Tables 1 and 2. Table 1 shows the chemical compositions of the component materials, and Table 2 shows the 100,000-hour creep rupture strengths of the component materials shown in Table 1. Here, #1 shown in Table 2 indicates a 100,000-hour creep rupture strength under conditions at a temperature of 600° C., and #2 indicates a 100,000-hour creep rupture strength under conditions at a temperature of 550° C. And, no mark indicates a 100,000-hour creep rupture strength under conditions at a temperature of 700° C. Here, the chemical compositions of the component materials configuring the high-temperature, intermediate-pressure turbine section 11*a* shown in Table 1 are mere examples, and those chemical compositions can be selected appropriately in the range of the chemical compositions of the heat-resistant alloys or heat-resistant alloy steels (M1) to (M14) forming the component members of the above-described steam turbine of the present invention.

In the steam turbine power plant 10, steam having a temperature lower than 650° C. flows to the high-pressure turbine 12, the low-temperature, intermediate-pressure turbine section 11*b*, the low-pressure turbine 13, the main steam pipe 17, the cold reheat pipe 18, the intermediate pressure section-connecting pipe 21 and the crossover pipe 22 excepting the high-temperature, intermediate-pressure turbine section 11*a*, so that the ferritic heat-resistant steels are mainly used for the component members.

TABLE 1

| | Chemical composition (wt%) | | | | | | | | | | | | | | | | |
|---|---|---|---|---|---|---|---|---|---|---|---|---|---|---|---|---|---|
| M | C | Si | Mn | P | S | Ni | Cr | Mo | W | N | Nb (+Ta) | Co | B | Ti | Al | Fe | Other |
| P1 | 0.06 | 0.35 | 1.62 | 0.029 | 0.003 | 20.2 | 24.5 | — | — | — | — | — | — | — | — | balance | — |
| P2 | 0.10 | 0.35 | 1.05 | 0.012 | 0.006 | 42.5 | 23.3 | — | 6.38 | — | 0.16 | — | — | 0.07 | 0.51 | balance | — |
| P3 | 0.09 | 0.47 | 0.48 | 0.009 | 0.004 | balance | 21.8 | 8.78 | — | — | — | 12.7 | 0.002 | 0.01 | 1.27 | 1.73 | — |
| P4 | 0.05 | 0.21 | 0.18 | 0.010 | 0.009 | balance | 21.2 | 8.94 | — | — | 3.51 | — | — | 0.14 | 0.14 | 1.73 | — |
| P5 | 0.07 | 0.52 | 0.32 | 0.012 | 0.011 | balance | 21.7 | 8.97 | 0.55 | — | — | 1.5 | — | — | — | 18.4 | — |
| P6 | 0.07 | 0.14 | 0.96 | 0.009 | 0.009 | 31.4 | 20.5 | — | — | — | — | — | — | 0.59 | 0.51 | balance | — |
| P7 | 0.04 | 0.04 | 0.03 | 0.009 | 0.009 | 53.3 | 18.2 | 3.10 | — | — | 5.04 | 0.01 | 0.004 | 1.03 | 0.51 | balance | — |
| P8 | 0.10 | 0.18 | 0.08 | 0.013 | 0.007 | balance | 12.8 | 4.16 | — | — | 2.37 | — | 0.007 | 0.74 | 6.12 | 1.76 | Zr: 0.09 |
| P9 | 0.03 | 0.16 | 0.56 | 0.019 | 0.011 | 36.2 | 17.3 | 2.58 | — | — | — | 18.6 | 0.004 | 2.69 | 0.23 | 21.8 | Zr: 0.03 |
| P10 | 0.05 | 0.09 | 0.05 | 0.012 | 0.006 | 43.0 | 11.9 | 6.05 | — | — | — | — | 0.012 | 2.51 | 0.28 | balance | — |
| P11 | 0.09 | 0.07 | 0.07 | 0.011 | 0.008 | 0.19 | 9.8 | 0.57 | 1.82 | 0.014 | 0.05 | 2.82 | 0.008 | — | — | balance | V: 0.19 |
| P12 | 0.14 | 0.03 | 0.64 | 0.009 | 0.005 | 0.69 | 10.0 | 0.99 | 1.01 | 0.04 | 0.05 | — | — | — | — | balance | V: 0.19 |
| P13 | 0.29 | 0.05 | 0.68 | 0.008 | 0.005 | 0.45 | 1.14 | 1.34 | — | — | — | — | — | — | — | balance | V: 0.29 |
| P14 | 0.29 | 0.05 | 0.58 | 0.009 | 0.002 | 0.31 | 1.75 | 0.78 | 1.14 | — | — | — | — | 0.005 | — | balance | V: 0.29 |

TABLE 1-continued

| M | Chemical composition (wt%) | | | | | | | | | | | | | | | | |
|---|---|---|---|---|---|---|---|---|---|---|---|---|---|---|---|---|---|
| | C | Si | Mn | P | S | Ni | Cr | Mo | W | N | Nb (+Ta) | Co | B | Ti | Al | Fe | Other |
| P15 | 0.14 | 0.48 | 0.51 | 0.010 | 0.005 | balance | 19.1 | 9.95 | — | — | — | 9.98 | — | 2.48 | 0.99 | — | — |
| P16 | 0.12 | 0.15 | 0.51 | 0.008 | 0.003 | 0.19 | 9.8 | 0.65 | 1.79 | 0.02 | 0.05 | 2.91 | 0.006 | 0.02 | — | balance | V: 0.19 |
| P17 | 0.04 | 0.48 | 0.82 | 0.010 | 0.004 | balance | 15.7 | — | — | — | 0.98 | — | — | 2.45 | 0.58 | 6.58 | — |
| P18 | 0.07 | 0.01 | 0.01 | 0.008 | 0.003 | balance | 19.7 | — | — | — | — | — | — | 2.41 | 1.46 | 0.2 | — |
| P19 | 0.08 | 0.55 | 0.80 | 0.015 | 0.006 | balance | 20.1 | — | — | — | — | 17.9 | — | 1.44 | 0.77 | — | — |
| P20 | 0.13 | 0.58 | 0.70 | 0.010 | 0.005 | balance | 14.8 | 4.92 | — | — | — | 20.3 | — | 1.21 | 4.33 | — | — |
| P21 | 0.06 | 0.53 | 0.64 | 0.010 | 0.003 | balance | 19.4 | 4.31 | — | — | — | 13.6 | 0.006 | 2.97 | 1.25 | — | Zr: 0.05 |
| P22 | 0.08 | 0.45 | 0.56 | 0.008 | 0.004 | balance | 18.1 | 4.01 | — | — | — | 18.5 | 0.005 | 2.98 | 2.91 | — | Zr: 0.05 |
| P23 | 0.08 | 0.76 | 0.99 | 0.014 | 0.002 | 24.8 | 20.2 | 1.45 | — | 0.17 | 0.23 | — | 0.005 | 0.04 | — | balance | — |
| P24 | 0.14 | 0.25 | 0.51 | 0.010 | 0.006 | 0.79 | 10.1 | 0.90 | — | 0.041 | 0.09 | — | — | — | — | balance | V: 0.22 |
| P25 | 0.14 | 0.22 | 0.80 | 0.009 | 0.005 | 0.25 | 1.15 | 0.95 | — | — | — | — | — | 0.012 | — | balance | V: 0.21 |

M: Material

TABLE 2

| Material | 100,000-hour creep repture strength (MPa) |
|---|---|
| P1 | 30-50 |
| P2 | 90-120 |
| P3 | 100-150 |
| P4 | 100-150 |
| P5 | 70-100 |
| P6 | 45-75 |
| P7 | 100-130 |
| P8 | 250-400 |
| P9 | 130-150 |
| P10 | 100-160 |
| P11 | 160-190 (#1) |
| P12 | 100-130 (#1) |
| P13 | 120-160 (#2) |
| P14 | 160-200 (#2) |
| P15 | 80-200 |
| P16 | 120-150 (#1) |
| P17 | 90-200 |
| P18 | 90-150 |
| P19 | 200-250 |
| P20 | 250-300 |
| P21 | 200-230 |
| P22 | 250-350 |
| P23 | 80-100 |
| P24 | 80-110 (#1) |
| P25 | 90-140 (#2) |

No mark: 700° C.
(#1): 600° C.
(#2): 550° C.

Rotor 32:

The rotor 32 of the high-temperature, intermediate-pressure turbine section 11*a* is formed of a material selected from materials P4, P7 and P21 in Table 1 and configured of plural disks and shafts or a single member.

The 100,000-hour creep rupture strength of each of the materials P4, P7 and P21 at a temperature of 700° C. is equivalent or better in comparison with a 100,000-hour creep rupture strength of materials P13 and P14 of the ferritic heat-resistant steel at a temperature of 550° C. or a 100,000-hour creep rupture strength of materials P11 and P12 of the ferritic heat-resistant steel at a temperature of. 600° C. Therefore, it is seen that the satisfactory strength characteristics can be obtained even in an extensive high-temperature environment by configuring the rotor 32 by the material P4, P7 or P21 as compared with a conventional intermediate-pressure turbine for which the ferritic heat-resistant steels has been used mainly.

Meanwhile, the ferritic heat-resistant steels such as the materials P11 to P14 could not be measured for a 100,000-hour creep rupture strength at a temperature of 700° C. When the materials P11 to P14 are used for the rotor 32, there are problems that the rotor 32 is heavily deformed and incapable of bearing a long-term operation in high-temperature steam environments where the steam flowing to the surface of the rotor 32 has a temperature of, for example, about 700° C. and oxidized to become thin considerably.

Buckets 34:

Because the buckets 34 are directly exposed to the high-temperature steam, they must be formed of a material having a high creep rupture strength at high temperature, and at least the first stage movable blade 34 is made of a material selected from materials P8, P15, P19, P20 and P22 in Table 1 and implanted in the rotor 32. These materials can be used to form all the buckets 34. The materials configuring the buckets 34 include those formed by a precision casting method and those formed by cutting after forging or rolling. But, they are selected considering a blade dimension based on the output power of the turbine and a load stress at the time of the operation.

It is seen that the 100,000-hour creep rupture strengths of the materials P8, P15, P19, P20 and P22 are equivalent to or better than that of the material forming the above-described rotor 32, and the strength characteristics required in a high-temperature environment can be obtained.

Meanwhile, the ferritic heat-resistant steels such as the materials P11 to P14, the austenitic heat-resistant steels such as materials P1, P6 and P23, or Ni-based alloys without addition of Al or Ti such as a material P5 cannot provide a creep rupture strength required for the buckets and cannot bear a long-term operation because of considerable deformation in a high-temperature steam environment at, for example, about 700° C.

Nozzles 33 or stationary blades may be formed of the same material as the buckets 34 because they are also exposed directly to the high-temperature steam.

Inner Casing 31 and Outer Casing 30:

The inner casing 31 and the outer casing 30 are formed of a material selected from the materials P1, P2, P4, P5 and P23 in Table 1. The 100,000-hour creep rupture strength is lower than that of the material forming the rotor 32 or the buckets 34, but the stationary parts such as the inner casing 31 and the outer casing 30 can adopt a material having a relatively low strength by changing their shape or thickness.

Meanwhile, the inner casing 31 and the outer casing 30 must be produced into a desired shape by casting, superior in casting property and use a material excelling in weldability because a repair and structural welding become inevitable. For example, the materials P8, P15, P19, P20 and P22 suitable for the buckets 34 excel in high-temperature creep rupture strength as shown in Table 2, but it is quite hard to cast or weld them as large products. And, the ferritic heat-resistant cast steels such as a material P16 or P24 excelling in casting property and weldability have problems that the ferritic heat-resistant cast steels are considerably deformed in a high-temperature steam environment of, for example, about 700° C., oxidized to become thin considerably and the like and cannot bear a long-term operation.

Nozzle Box 35:

The nozzle box 35 is configured of a single member or plural welded members formed of a material selected from the materials P1 to P6 and the material P23 in Table 1.

The 100,000-hour creep rupture strengths of the materials P1 to P6 and the material P23 at a temperature of 700° C. are different depending on the materials, but for a stationary part such as the nozzle box 35, a component material can be selected by adjusting the thickness of the nozzle box 35 according to an outer surface temperature of the nozzle box 35 and the creep rupture strengths shown in Table 2.

Meanwhile, the ferritic heat-resistant steels such as the materials P11 to P14, the material P16, the material P24 and material P25 cannot bear a long-term operation in an environment where high-temperature steam of, for example, about 700° C. flows into the nozzle box 35. And, the nozzle box 35 is essentially welded, but the materials P7 to P10, the material P15 and materials P17 to P22 have problems that they cannot be welded or have poor weldability.

Hot Reheat Pipe 20:

The hot reheat pipe 20 is configured of a material selected from the materials P1 to P4 and the material P23 in Table 1. The hot reheat pipe 20 is configured of a seamless tube or a seamed tube. The inner surface of the hot reheat pipe 20 is directly exposed to the high-temperature steam, so that it is desirably configured of a material resistable to high temperatures.

The 100,000-hour creep rupture strengths of the materials P1 to P4 and the material P23 at a temperature of 700° C. are variable depending on the materials, but for the stationary part such as the hot reheat pipe 20, a component material can be selected by adjusting the thickness of the hot reheat pipe 20 according to the outer surface temperature of the hot reheat pipe 20 and the creep rupture strengths shown in Table 2.

Meanwhile, the ferritic heat-resistant steels such as the materials P11 to P14 and the material P16 cannot bear a long-term operation in an environment where the high-temperature steam of, for example, about 700° C., flows into the hot reheat pipe 20. And, the hot reheat pipe 20 must have a welded structure, but the materials P7 to P10, the material P15, the materials P17 to P22 have problems that they cannot be welded or have poor weldability.

In the steam turbine power plant 10 of the first embodiment described above, the intermediate-pressure turbine is separated into the high-temperature, high-pressure side high-temperature, intermediate-pressure turbine section 11*a* and the low-temperature, low-pressure side low-temperature, intermediate-pressure turbine section 11*b*, and the rotor 32, the buckets 34, the inner casing 31, the outer casing 30, the nozzle box 35 and the hot reheat pipe 20 configuring the high-temperature, intermediate-pressure turbine section 11*a* exposed to steam having a temperature of 650° C. or more are formed of the austenitic heat-resistant steels or the Ni-based alloys excelling in high-temperature properties. Thus, an operation in an extensive high-temperature environment becomes possible as compared with a conventional steam turbine power plant.

In the high-temperature, intermediate-pressure turbine section 11*a*, the rotor 32, the buckets 34, the inner casing 31, the outer casing 30, the nozzle box 35 and the hot reheat pipe 20 configuring the high-temperature, intermediate-pressure turbine section 11*a* can be used in the steam having a temperature of 650° C. or more without cooling by cooling steam. Thus, thermal efficiency can be improved.

Besides, the steam turbine and the like other than the high-temperature, intermediate-pressure turbine section 11*a* do not require the use of the austenitic heat-resistant steels or the Ni-based alloys for the main parts and can use a suitable material selected from the conventionally used ferritic heat-resistant steels. Thus, a rise in facility cost can be suppressed.

And, in the steam turbine power plant 10, the austenitic heat-resistant steels or the Ni-based alloys are used for the high-temperature, intermediate-pressure turbine section 11*a*, so that the restriction on a design of resistance to a pressure is relaxed and the high-temperature, intermediate-pressure turbine section 11*a* can be made thin compared with the case that such materials are used for the high-pressure turbine. Thus, in the high-temperature, intermediate-pressure turbine section 11*a*, an excessively high thermal stress to be generated in the austenitic heat-resistant steels or the Ni-based alloys when a load is varied particularly at the time of activating or stopping the plant can be suppressed, and a steam turbine power plant having high reliability can be provided.

Second Embodiment

Figure 3:
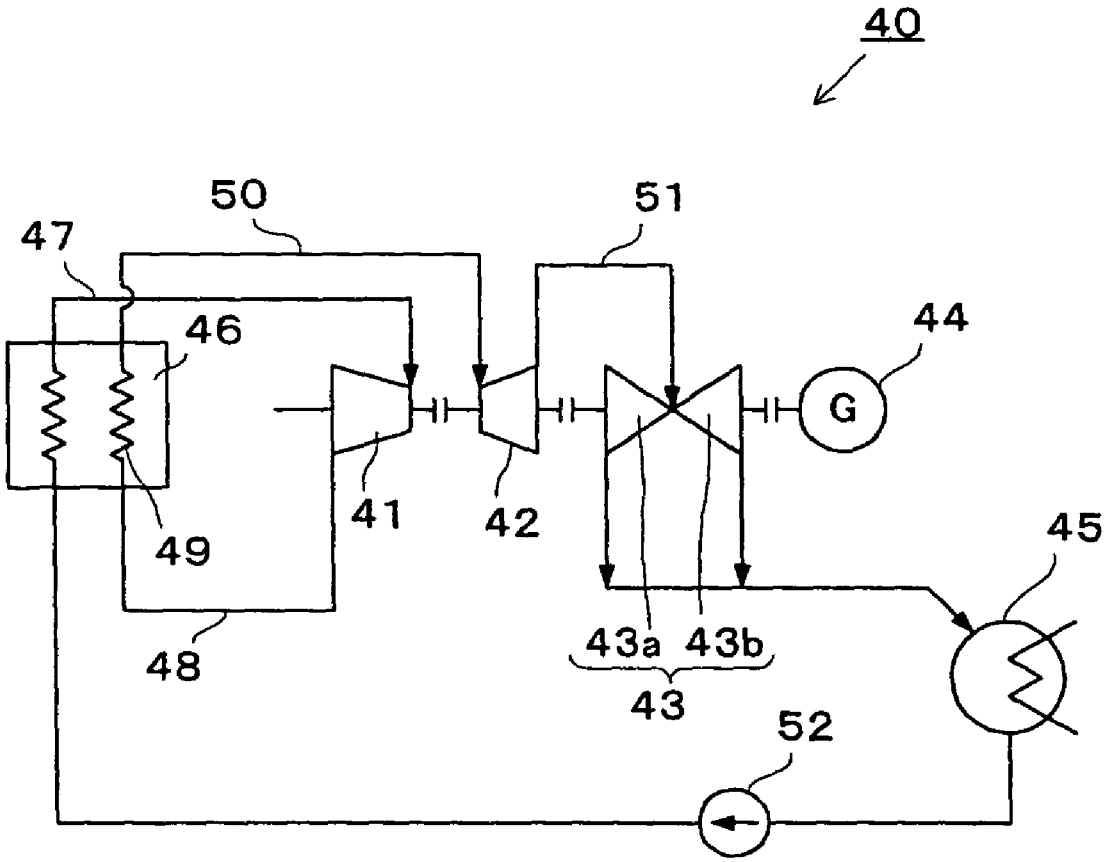
FIG. 3 is a diagram showing an overview of the structure of the steam turbine power plant according to a second embodiment of the present invention.

A steam turbine power plant 40 according to a second embodiment of the invention will be described with reference to FIG. 3. FIG. 3 shows an overview of the structure of the steam turbine power plant 40.

The steam turbine power plant 40 is configured without having the intermediate-pressure turbine separated, and the steam turbine power plant 40 is mainly comprised of a high-pressure turbine 41, an intermediate-pressure turbine 42, a low-pressure turbine 43, a generator 44, a condenser 45 and a boiler 46. The intermediate-pressure turbine 42 into which high-temperature steam having a temperature of 650° C. or more is introduced is configured of austenitic heat-resistant steels or Ni-based alloys.

Subsequently, a work of steam in the steam turbine power plant 40 will be described.

Steam, which is heated to a temperature lower than 650° C., for example, 630° C., by and flows out of the boiler 46, flows through a main steam pipe 47 to enter the high-pressure turbine 41 at a pressure of 250 ata. When it is assumed that the buckets of the high-pressure turbine 41 are configured of, for example, nine stages, the steam performs a work of expansion in the high-pressure turbine 41, is exhausted through a ninth stage outlet at a steam temperature of 420° C. and a pressure of 70 ata, and flows through a cold reheat pipe 48 to enter a reheater 49. The reheater 49 reheats the entered steam to a temperature of 650° C. or more, for example, 700° C. The reheated steam flows through a hot reheat pipe 50 which functions as a lead pipe to enter the intermediate-pressure turbine 42 at a pressure of 55 ata.

If the buckets of the intermediate-pressure turbine 42 are configured of, for example, eight stages, the steam having flown into the intermediate-pressure turbine 42 and performed a work of expansion is exhausted from an eighth stage outlet and supplied to the low-pressure turbine 43 at, for example, a steam temperature of 360° C. and a pressure of 7 ata through a crossover pipe 51.

In the low-pressure turbine 43, two low-pressure turbine sections 43*a*, 43*b* having the same structure are connected tandem. The buckets of each of the low-pressure turbine sections 43*a*, 43*b* have four stages, and the low-pressure turbine section 43*a* and the low-pressure turbine section 43*b* are configured substantially symmetrically. The steam supplied to the low-pressure turbine 43 performs a work of expansion, is condensed by the condenser 45, raised its pressure by a boiler feed pump 52 and returned back to the boiler 46. The condensed water returned back to the boiler 46 becomes steam and supplied again to the high-pressure turbine 41 through the main steam pipe 47. The generator 44 is driven to rotate by the work of expansion performed by the individual steam turbines to generate electricity.

Then, the intermediate-pressure turbine 42 will be described with reference to FIG. 4.

Figure 4:
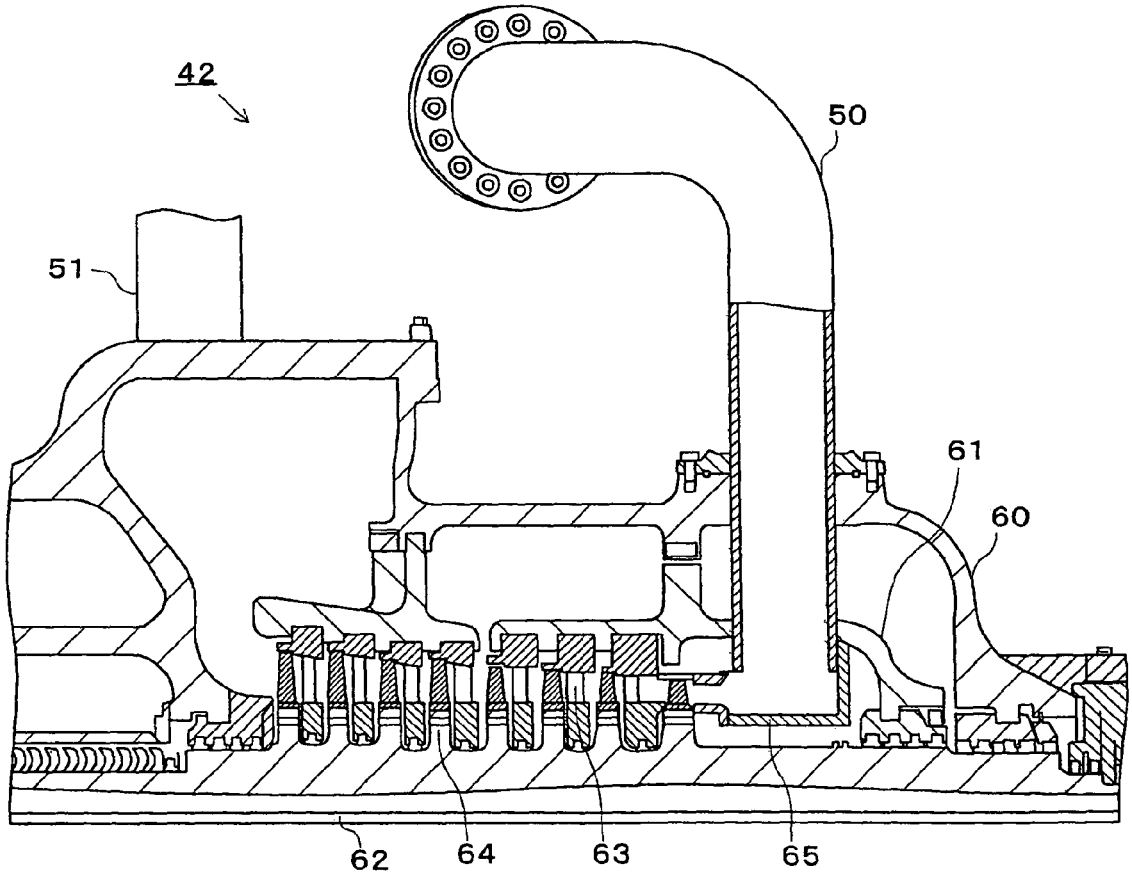
FIG. 4 is a sectional view of the upper half casing section of an intermediate-pressure turbine.

FIG. 4 shows a sectional view of the upper half casing portion of the intermediate-pressure turbine 42.

In the intermediate-pressure turbine 42, an inner casing 61 is disposed within an outer casing 60, and a rotor 62 is disposed to pierce into the inner casing 61. And, nozzles 63 of, for example, eight stages are disposed on the inner surface of the inner casing 61, and buckets 64 are implanted in the rotor 62. Besides, a hot reheat pipe 50 is disposed on the intermediate-pressure turbine 42 through the outer casing 60 and the inner casing 61, and an end of the hot reheat pipe 50 is connected in a row with a nozzle box 65 which guides the steam toward the buckets 64.

Subsequently, a work of steam in the intermediate-pressure turbine 42 will be described.

Steam heated to a temperature of 650° C. or more, for example, 700° C. by the reheater 49 flows at a pressure of 55 ata into the nozzle box 65 within the intermediate-pressure turbine 42 through the hot reheat pipe 50. The steam flown into the nozzle box 65 is guided to the nozzles 63 and the buckets 64, performs a work of expansion, and is supplied to the low-pressure turbine 43 through the crossover pipe 51.

Here, the component materials for the individual portions of the rotor 62, the buckets 64, the inner casing 61, the outer casing 60, the nozzle box 65 and the hot reheat pipe 50 configuring the intermediate-pressure turbine 42 are the same those for the corresponding portions of the rotor 32, the buckets 34, the inner casing 31, the outer casing 30, the nozzle box 35 and the hot reheat pipe 20 configuring the high-temperature, intermediate-pressure turbine section 11*a* of the steam turbine power plant 10 according to the first embodiment.

In the steam turbine power plant 40, the steam having a temperature lower than 650° C. flows to the high-pressure turbine 41, the low-pressure turbine 43, the main steam pipe 47, the cold reheat pipe 48 and the crossover pipe 51 other than the intermediate-pressure turbine 42, so that ferritic heat-resistant steels are mainly used for the above component members. And, the nozzles 63 or the stationary blades are also exposed directly to the high-temperature steam, so that they may be formed of the same material as that of the buckets 34.

As described above, in the steam turbine power plant 40 according to the second embodiment, the rotor 62, the buckets 64, the inner casing 61, the outer casing 60, the nozzle box 65 and the hot reheat pipe 50 configuring the intermediate-pressure turbine 42 which is exposed to the steam having a temperature of 650° C. or more are formed of the austenitic heat-resistant steels or the Ni-based alloys excelling in high-temperature properties. Therefore, an operation in an extensive high-temperature environment can be made as compared with a conventional steam turbine power plant.

And, in the intermediate-pressure turbine 42, the rotor 62, the buckets 64, the inner casing 61, the outer casing 60, the nozzle box 65 and the hot reheat pipe 50 configuring the intermediate-pressure turbine 42 can be used in the steam having a temperature of 650° C. or more without cooling by cooling steam. Therefore, thermal efficiency can be improved.

Besides, in the steam turbine power plant 40, the austenitic heat-resistant steels or the Ni-based alloys are used for the intermediate-pressure turbine 42. Therefore, the restriction on a design of resistance to a pressure is relaxed and the intermediate-pressure turbine 42 can be made thin compared with the case that such materials are used for the high-pressure turbine. Thus, in the intermediate-pressure turbine 42, an excessively high thermal stress generated in the austenitic heat-resistant steels or the Ni-based alloys when a load is varied particularly at the time of activating or stopping the plant can be suppressed, and a steam turbine power plant having high reliability can be provided.

Third Embodiment

The steam turbine power plant according to a third embodiment of this invention will be described with reference to FIG. 5. The steam turbine power plant according to the third embodiment of the invention has the same structure as that of the steam turbine power plant 10 of the first embodiment except that a structure for cooling individual components is added to the high-temperature, intermediate-pressure turbine section 11*a* of the first embodiment.

Figure 5:
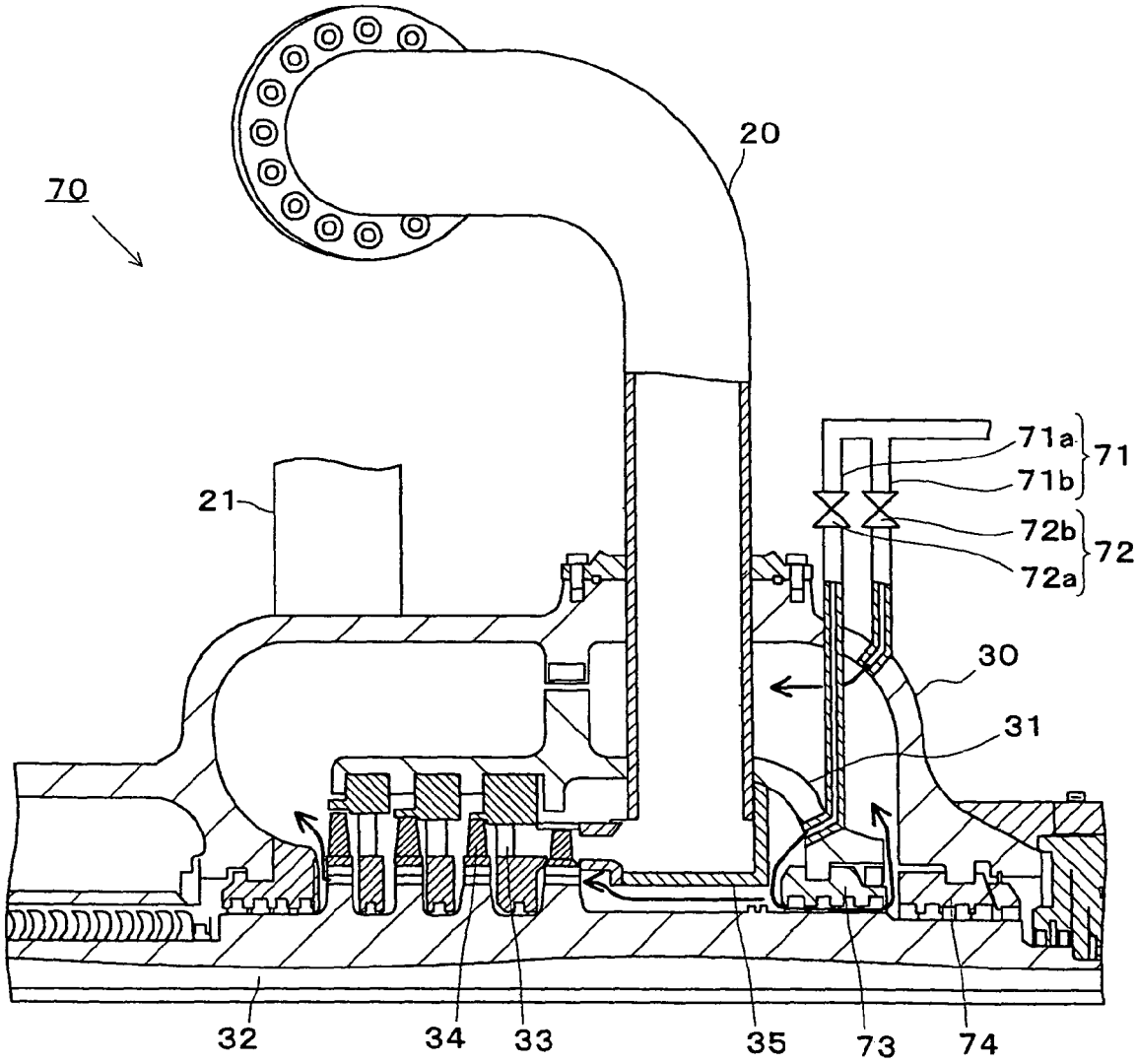
FIG. 5 is a sectional view of the upper half casing section of a high-temperature, intermediate-pressure turbine section provided with a steam cooling unit.

FIG. 5 shows a sectional view of the upper half casing section of a high-temperature, intermediate-pressure turbine section 70 having a structure for mainly cooling the rotor 32 and the outer casing 30. The same reference numerals are allotted to the same elements as those of the high-temperature, intermediate-pressure turbine section 11*a* of the first embodiment, and their overlapped descriptions are omitted.

The high-temperature, intermediate-pressure turbine section 70 is provided with a cooling steam pipe 71 comprising a cooling steam branch pipe 71*a* and a cooling steam branch pipe 71*b*.

The cooling steam branch pipe 71*a* is disposed with its end surface protruded into the inner casing 31 where the nozzle box 35 is disposed or faced the inside of the inner casing 31 through the outer casing 30 of the high-temperature, intermediate-pressure turbine section 70. The cooling steam branch pipe 71*b* is disposed with its end surface protruded into the outer casing 30 of the high-temperature, intermediate-pressure turbine section 70 or faced to the inner surface of the outer casing 30. And, the cooling steam branch pipe 71*a* and the cooling steam branch pipe 71*b* are provided with pressure adjusting valves 72*a*, 72*b* respectively, and cooling steam can be supplied into only the inner casing 31, only between the outer casing 30 and the inner casing 31, or both of them by the pressure adjusting valves 72*a*, 72*b*, and a flow rate of the supplied cooling steam can also be adjusted.

Here, as the cooling steam, for example, a part of the steam exhausted from the high-pressure turbine 12 after the work of expansion is performed by the high-pressure turbine 12 or a part of the steam extracted from the high-pressure turbine 12 can be used. The cooling steam is desirably steam having a temperature lower than that of the steam flowing through the high-temperature, intermediate-pressure turbine section 70, and steam other than that of the high-pressure turbine 12 can also be used.

Cooling of Rotor 32:

Supply of cooling steam through the cooling steam branch pipe 71*a* will be described. In this case, the pressure adjusting valve 72*a* is open, while the pressure adjusting valve 72*b* is closed.

The cooling steam guided to the periphery of the nozzle box 35 in the inner casing 31 through the cooling steam branch pipe 71*a* flows into a seal portion 73 such as a gland packing between the rotor 32 and the inner casing 31 while cooling the rotor 32. The cooling steam flown into the seal portion is guided from a portion between the seal portion 73 disposed in the inner casing 31 and a seal portion 74 disposed in the outer casing 30 to a portion between the outer casing 30 and the inner casing 31.

And, the cooling steam guided to the portion between the outer casing 30 and the inner casing 31 flows between the outer casing 30 and the inner casing 31 toward the intermediate pressure section-connecting pipe 21 is guided together with the steam having performed the work of expansion in the high-temperature, intermediate-pressure turbine section 70 to the intermediate pressure section-connecting pipe 21. The outer casing 30 and the inner casing 31 are also cooled in the cooling process. The cooling steam is first guided from the cooling steam branch pipe 71*a* to the periphery of the nozzle box 35, so that the nozzle box 35 is also cooled. The inner surface of the nozzle box 35 is directly exposed to the high-temperature steam, so that it is desirably formed of a material resistant to a high temperature even if its outer surface is cooled by the cooling steam. Here, the same material as that for the nozzle box 35 according to the first embodiment is used for the nozzle box 35.

The cooling steam guided to the periphery of the nozzle box 35 in the inner casing 31 through the cooling steam branch pipe 71*a* flows, for example, along a part where the buckets of the rotor 32 are implanted through the cooling steam passage hole formed in a convex portion of the rotor 32 while cooling the rotor 32. And, the cooling steam having flown through the cooling steam passage flows out to downstream of the final stage movable blade 34 and guided together with the steam which has performed the work of expansion in the high-temperature, intermediate-pressure turbine section 70 to the intermediate pressure section-connecting pipe 21. Cooling of the portion where the buckets of the rotor 32 are implanted is not limited to the above method, and the portion where the buckets of the rotor 32 are implanted can be cooled by any method if cooling steam is used for cooling.

By cooling the rotor 32 as described above, for example, when the cooling steam has a temperature of 500° C. or less, the cooling steam can keep the rotor 32 at a temperature of 600° C. or less because the cooling steam has a temperature lower than that of the steam which is introduced through the hot reheat pipe 20 and has a temperature of 650° C. or more, for example, 700° C.

Then, the component materials of the rotor 32 will be described with reference to Tables 1 and 2.

The rotor 32 is configured of a single member or plural members welded of a material selected from the materials P11 to P14 in Table 1. They are selected according to the relationship between the surface temperature of the rotor 32 cooled by the cooling steam and the 100,000-hour creep rupture strengths shown in Table 2.

The rotor 32 of the high-temperature, intermediate-pressure turbine section 70 configured of the materials P11 to P14 has the surface of the rotor 32 and the implanted portion of the buckets of the rotor 32 cooled by the cooling steam. Therefore, the rotor 32 can be formed of the ferritic heat-resistant steels which are widely used for a conventional steam turbine power plant even if the steam introduced through the hot reheat pipe 20 has a temperature of 650° C. or more, for example, 700° C. Thus, the operation in an extensive high-temperature environment becomes possible and thermal efficiency can be improved in comparison with the conventional steam turbine power plant.

An operation at a temperature lower than the service temperature limit of the ferritic heat-resistant steels can be made possible in a state that the drop of the thermal efficiency of the high-temperature, intermediate-pressure turbine section 70 because of cooling of the rotor 32 by the cooling steam is suppressed to a minimum.

Besides, because the rotor 32 can be formed of the ferritic heat-resistant steels, the high-temperature, intermediate-pressure turbine section 70, which is following a conventional design concept and has high reliability, can be configured at a low cost.

Meanwhile, where the rotor 32 is formed of a material having a creep rupture strength superior to the materials P11 to P14 shown in Table 2 even if a structure effectively using cooling steam is adopted for the high-temperature, intermediate-pressure turbine section 70, the economical efficiency of the members, the production cost and the like is impaired in addition to a little reduction of thermal efficiency in comparison with a case that the cooling steam is not used.

Cooling of Outer Casing 30:

Then, the supply of cooling steam through the cooling steam branch pipe 71*b* will be described. In this case, the pressure adjusting valve 72*a* is closed, and the pressure adjusting valve 72*b* is open.

The cooling steam guided through the cooling steam branch pipe 71*b* to the portion between the outer casing 30 and the inner casing 31 flows between the outer casing 30 and the inner casing 31 while cooling them toward the intermediate pressure section-connecting pipe 21. And, it is guided together with the steam which has performed the work of expansion in the high-temperature, intermediate-pressure turbine section 70 to the intermediate pressure section-connecting pipe 21. The cooling steam branch pipe 71*b* is desirably located at a position so that the cooling steam can cool from one end to the other end between the outer casing 30 and the inner casing 31 along a longitudinal direction of the high-temperature, intermediate-pressure turbine section 70. Therefore, it is desirable to dispose the cooling steam branch pipe 71*b* at the other end opposite to one end of the high-temperature, intermediate-pressure turbine section 70 where the intermediate pressure section-connecting pipe 21 is disposed as shown in, for example, FIG. 5. By cooling by the cooling steam, the outer casing 30 can be entirely kept at a temperature of, for example, 600° C. or less even when the steam introduced through the hot reheat pipe 20 has a temperature of 650° C. or more, for example, 700° C.

Then, the component materials of the outer casing 30 will be described with reference to Tables 1 and 2.

The outer casing 30 is formed of a material selected from the materials P16, P24 and P25 in Table 1. The materials P16, P24 and P25 of the ferritic heat-resistant steel are easily produced as a large member having a complex shape, so that the outer casing 30 having a complex shape is produced using, for example, such materials by casting. The high-temperature, intermediate-pressure turbine section 70 which is highly reliable and inexpensive can be configured because insufficient mechanical properties at a high temperature can be remedied by limiting the temperature to 600° C. or less.

Besides, the outer casing 30 can be formed of the ferritic heat-resistant steels, so that the high-temperature, intermediate-pressure turbine section 70, which is following a conventional design concept and has high reliability, can be configured at a low cost.

Meanwhile, where the outer casing 30 is formed using a material having a creep rupture strength superior to the materials P16, P24 and P25 shown in Table 2 even if a structure effectively using the cooling steam is adopted for the high-temperature, intermediate-pressure turbine section 70, the economical efficiency of the members, the production cost and the like is impaired in addition to a little reduction of thermal efficiency in comparison with a case that the cooling steam is not used.

Here, both the pressure adjusting valve 72*a* and the pressure adjusting valve 72*b* may be opened to supply the cooling steam from both the cooling steam branch pipe 71*a* and the cooling steam branch pipe 71*b* to the high-temperature, intermediate-pressure turbine section 70. In this case, both the cooling effect of the rotor 32 and the cooling effect of the outer casing 30 described above can be obtained. Thus, the rotor 32 and the outer casing 30 can be formed of ferritic heat-resistant steels, so that the high-temperature, intermediate-pressure turbine section 70, which is following a conventional design concept and has high reliability, can be configured at a low cost.

Figure 6:
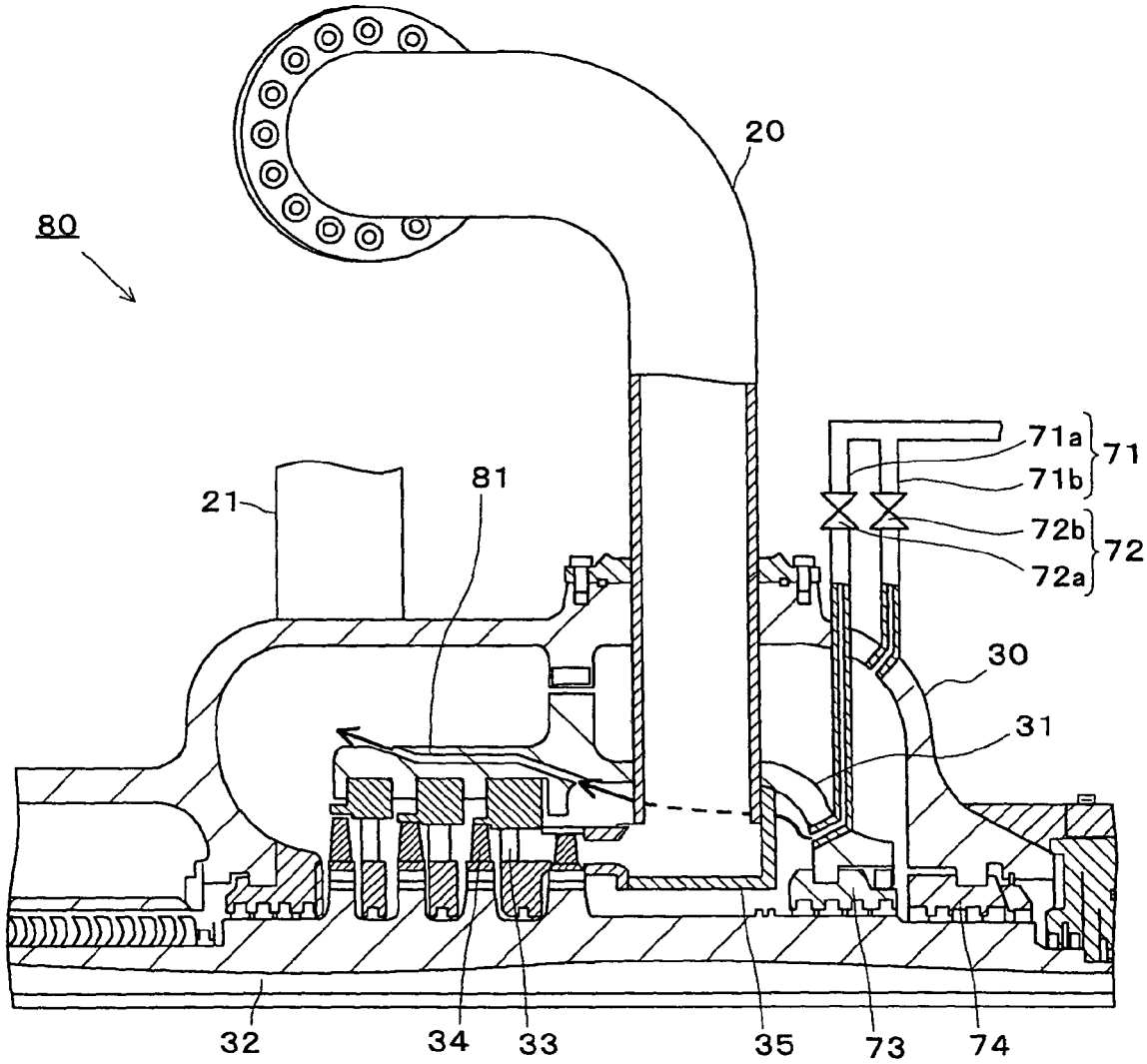
FIG. 6 is a sectional view of the upper half casing section of the high-temperature, intermediate-pressure turbine section provided with the steam cooling unit.

Cooling of Inner Casing 31:

FIG. 6 shows a sectional view of the upper half casing section of a high-temperature, intermediate-pressure turbine section 80 having a structure mainly cooling the inner casing 31 in addition to the structure of the high-temperature, intermediate-pressure turbine section 70 shown in FIG. 5. The same reference numerals are allotted to the same elements as those of the high-temperature, intermediate-pressure turbine section 70 shown in FIG. 5, and their overlapped descriptions are omitted.

In the high-temperature, intermediate-pressure turbine section 80, a cooling steam passage 81, which communicates the interior of the inner casing 31 where the nozzle box 35 is disposed and a space formed between the outer casing 30 and the inner casing 31, is formed in the inner casing 31.

The cooling steam guided from the cooling steam branch pipe 71*a* to the periphery of the nozzle box 35 in the inner casing 31 flows between the inner wall of the inner casing 31 and the nozzle box 35 while cooling the inner casing 31 toward the cooling steam passage 81. The cooling steam guided to the portion between the outer casing 30 and the inner casing 31 through the cooling steam passage 81 flows between the outer casing 30 and the inner casing 31 toward the intermediate pressure section-connecting pipe 21 and is guided together with the steam having performed the work of expansion in the high-temperature, intermediate-pressure turbine section 80 to the intermediate pressure section-connecting pipe 21. In this cooling process, the nozzle box 35 is also cooled. Because the inner surface of the nozzle box 35 is directly exposed to the high-temperature steam, it is desirably configured of a material resistant to high temperatures even when its outer surface is cooled by the cooling steam. Here, the same material as that for the nozzle box 35 described in the first embodiment is used for the nozzle box 35.

By cooling by the cooling steam, the inner casing 31 can be entirely kept at a temperature of, for example, 600° C. or less even when the steam introduced through the hot reheat pipe 20 has a temperature of 650° C. or more, for example, 700° C.

Then, the component materials of the inner casing 31 will be described with reference to Tables 1 and 2.

The inner casing 31 is formed of a material selected from the materials P16, P24 and P25 in Table 1. The materials P16, P24 and P25 of the ferritic heat-resistant steel are easily produced as a large member having a complex shape, so that the inner casing 31 having a complex shape is produced using, for example, such materials by casting. The high-temperature, intermediate-pressure turbine section 80 which is highly reliable and inexpensive can be configured because insufficient mechanical properties at a high; temperature can be remedied by limiting the temperature to 600° C. or less.

Besides, the inner casing 31 can be formed of the ferritic heat-resistant steels, so that the inner casing 31, which is following a conventional design concept and having high reliability, can be configured at a low cost.

Meanwhile, where the inner casing 31 is formed using a material having a creep rupture strength superior to the materials P16, P24 and P25 shown in Table 2 even if a structure effectively using the cooling steam is adopted for the high-temperature, intermediate-pressure turbine section 80, the economical efficiency of the members, the production cost and the like is impaired in addition to a little reduction of thermal efficiency in comparison with a case that the cooling steam is not used. Besides, the materials other than the material P16, P24 and P25 have problems their formability and weldability are poor when used for a large member.

Here, both the pressure adjusting valve 72*a* and the pressure adjusting valve 72*b* may be opened to supply the cooling steam from both the cooling steam branch pipe 71*a* and the cooling steam branch pipe 71*b* to the high-temperature, intermediate-pressure turbine section 80. In this case, all the cooling effect of the rotor 32, the cooling effect of the outer casing 30 and the cooling effect of the inner casing 31 described above can be obtained. Thus, the rotor 32, the outer casing 30 and the inner casing 31 can be formed of a ferritic heat-resistant steels, so that the high-temperature, intermediate-pressure turbine section 80, which is following a conventional design concept and has high reliability, can be configured at a low cost.

In the steam turbine power plant of the third embodiment described above, the structure for mainly cooling, for example, the rotor 32, the outer casing 30 and the inner casing 31 of the high-temperature, intermediate-pressure turbine section 80 by the cooling steam is provided, so that the rotor 32, the outer casing 30 and the inner casing 31 can be made to have a temperature of 600° C. or less even when the steam introduced through the hot reheat pipe 20 has a temperature of 650° C. or more, for example, 700° C. Thus, such components can be formed of the ferritic heat-resistant steels which are widely used for a conventional steam turbine power plant. And, the high-temperature, intermediate-pressure turbine section, which is following a conventional design concept and has high reliability, can be configured at a low cost.

Because the steam of 650° C. or more is introduced into the high-temperature, intermediate-pressure turbine section 80, the thermal efficiency higher than that of a conventional steam turbine operated by steam of 600° C. or less can be obtained.

In the steam turbine power plant of the third embodiment described above, the high-temperature, intermediate-pressure turbine section which is a division of the intermediate-pressure turbine is provided with the steam cooling unit, but the structure wherein the steam cooling means which is provided for the high-temperature, intermediate-pressure turbine section and mainly cools the rotor 32, the outer casing 30 and the inner casing 31 of the high-temperature, intermediate-pressure turbine section by the cooling steam can also be applied to the intermediate-pressure turbine which is not divided in the second embodiment.

Fourth Embodiment

The steam turbine power plant according to a fourth embodiment of the invention will be described with reference to FIG. 7 and FIG. 8. The steam turbine power plant according to the fourth embodiment of the invention has the same structure as that of the steam turbine power plant according to the third embodiment except that a high-temperature, intermediate-pressure turbine section 90 provided with a single-structure casing 91 is provided instead of the high-temperature, intermediate-pressure turbine section 70 provided with the outer casing 30 and the inner casing 31 of the third embodiment.

Figure 7:
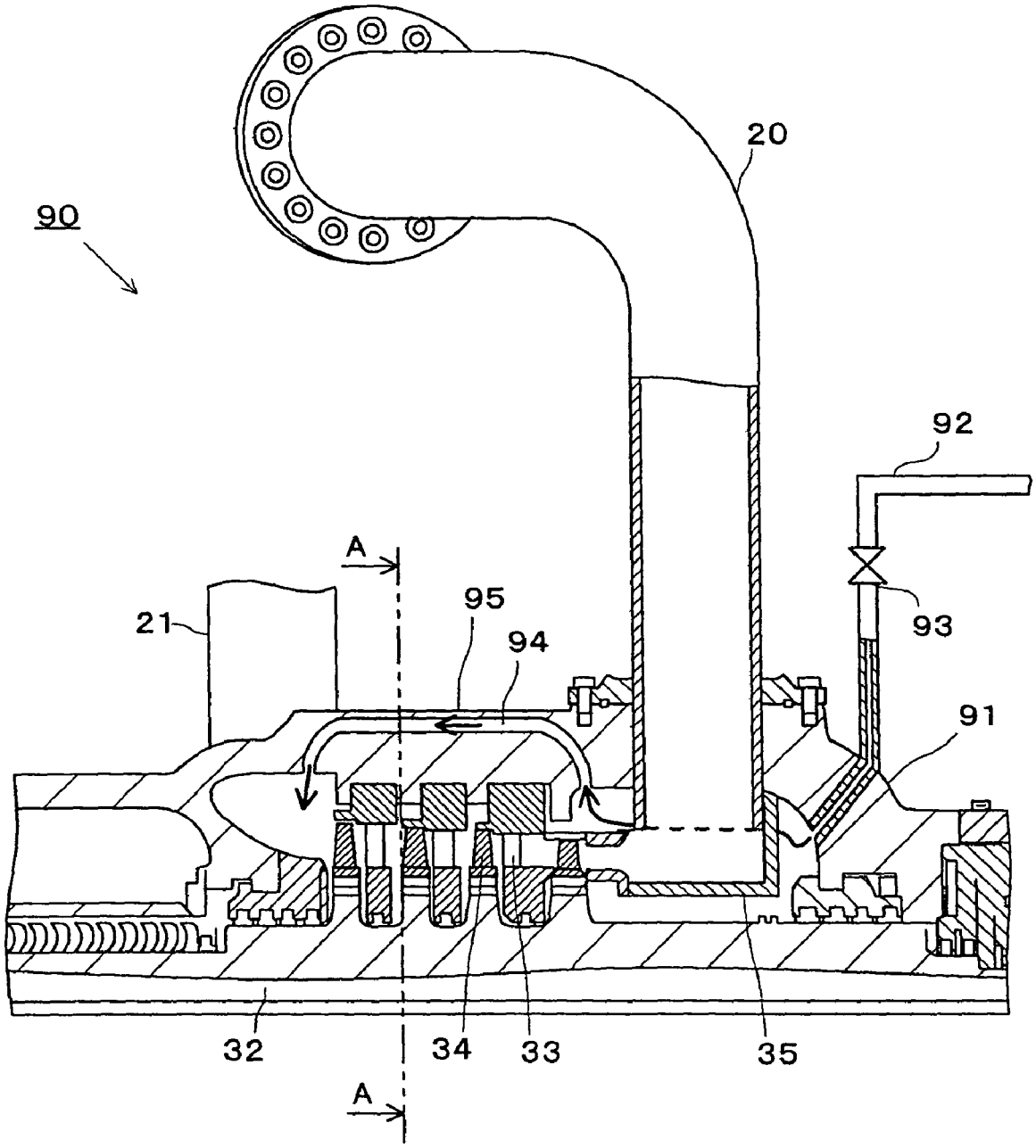
FIG. 7 is a sectional view of the upper half casing section of the high-temperature, intermediate-pressure turbine section provided with the steam cooling unit.
Figure 8:
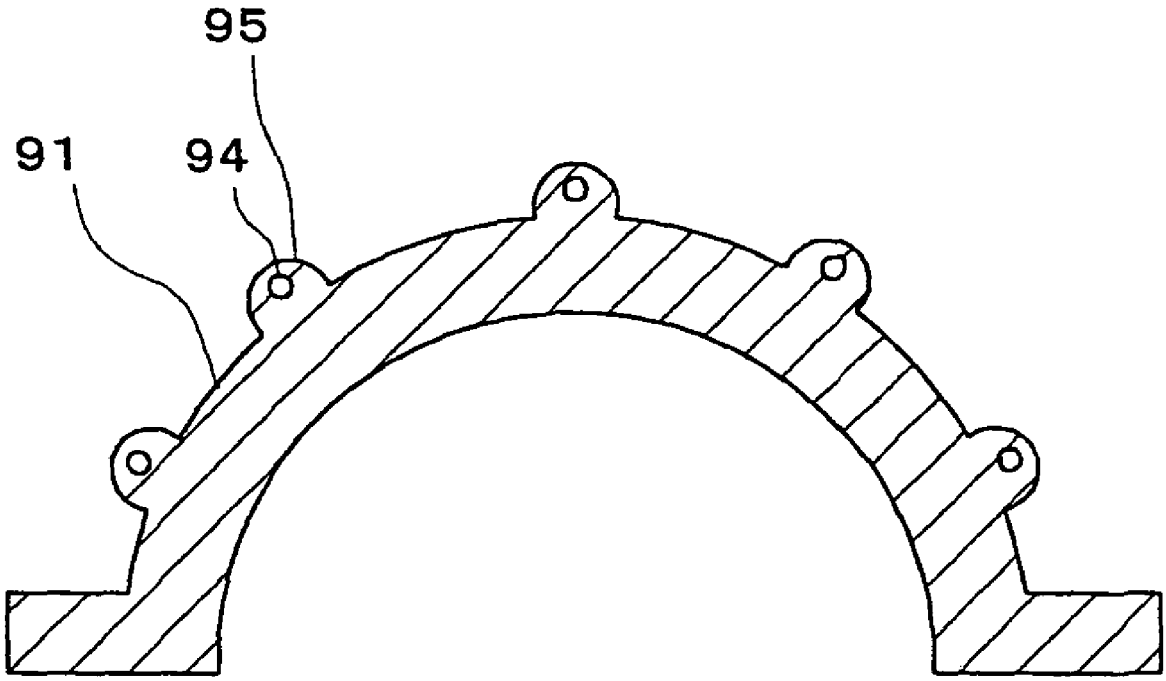
FIG. 8 is a sectional view taken along A-A of FIG. 7.

FIG. 7 shows a sectional view of the upper half casing section of the high-temperature, intermediate-pressure turbine section 90 having the structure for mainly cooling the casing 91. FIG. 8 shows a sectional view of the casing 91 taken along line A-A of FIG. 7. The same reference numerals are allotted to the same elements as those of the high-temperature, intermediate-pressure turbine section 70 of the steam turbine power plant of the third embodiment, and their overlapped descriptions are omitted.

The high-temperature, intermediate-pressure turbine section 90 is provided with a cooling steam pipe 92 of which end face is protruded into the casing 91 where the nozzle box 35 is disposed or faced the inner surface of the casing 91. The cooling steam pipe 92 is provided with a pressure adjusting valve 93, and a flow rate of the cooling steam supplied into the casing 91 can be adjusted by the pressure adjusting valve 93.

Here, as the cooling steam, for example, a part of the steam exhausted from the high-pressure turbine 12 after the work of expansion is performed by the high-pressure turbine 12 or a part of the steam extracted from the high-pressure turbine 12 can be used. The cooling steam is desirably steam having a temperature lower than that of the steam flowing through the high-temperature, intermediate-pressure turbine section 90, and steam other than that of the high-pressure turbine 12 can also be used.

A cooling steam passage 94 is formed in the casing 91 in the longitudinal direction of the casing 91 in which the nozzles 33 are disposed. This cooling steam passage 94 is preferably formed to downstream of the final stage movable blade 34. As shown in FIG. 8, the cooling steam passage 94 is formed, for example, within plural protruded line portions 95 which are formed along the longitudinal direction of the casing 91 on the outer surface of the casing 91. The plural protruded line portions 95 are preferably disposed evenly on the outer surface of the casing 91. The configuration for forming the cooling steam passage 94 is not limited to what is described above and may be formed as desired if the casing 91 can be cooled by cooling steam.

Then, a flow of the cooling steam supplied from the cooling steam pipe 92 into the casing 91 will be described.

The cooling steam guided from the cooling steam pipe 92 to the periphery of the nozzle box 35 in the casing 91 flows between the inner wall of the casing 91 and the outer wall of the nozzle box 35 toward the cooling steam passage 94 while cooling the casing 91. Besides, the cooling steam guided to the cooling steam passage 94 flows through the cooling steam passage 94 while cooling the casing 91. And, the cooling steam having passed through the cooling steam passage 94 is guided together with the steam which has performed the work of expansion in the high-temperature, intermediate-pressure turbine section 90 to the intermediate pressure section-connecting pipe 21. The nozzle box 35 is also cooled in this cooling step. The inner wall of the nozzle box 35 is directly exposed to the high-temperature steam, so that it is preferable to configure by a material resistant to high temperatures even if its outer surface is cooled by the cooling steam. Here, the same material as that for the nozzle box 35 described in the first embodiment is used for the nozzle box 35.

By cooling by the cooling steam, the casing 91 can be entirely kept at a temperature of, for example, 600° C. or less even when the steam introduced through the hot reheat pipe 20 has a temperature of 650° C. or more, for example, 700° C.

As described above in connection with the cooling of the rotor 32 of the third embodiment, a part of the cooling steam guided into the casing 91 through the cooling steam pipe 92 flows through a cooling steam passage hole formed in the convex portion of the rotor 32 while cooling the rotor 32 along, for example, the portion of the rotor 32 where the buckets are implanted. Therefore, the rotor 32 is also cooled in the cooling step of the casing 91.

Then, the component materials of the casing 91 will be described with reference to Table 1 and Table 2.

The casing 91 is formed of a material selected from the materials P16, P24 and P25 in Table 1. The materials P16, P24 and P25 of the ferritic heat-resistant steel are easily produced as a large member having a complex shape. Therefore, the casing 91 having a complex shape is produced using, for example, such a material by casting. The high-temperature, intermediate-pressure turbine section 90 which is highly reliable and inexpensive can be configured because insufficient mechanical properties at a high temperature can be remedied by limiting the temperature to 600° C. or less.

Besides, because the casing 91 can be configured of the ferritic heat-resistant steels, the inner casing 91, which is following a conventional design concept and has high reliability, can be configured at a low cost.

Meanwhile, where the casing 91 is formed using a material having a creep rupture strength superior to the materials P16, P24 and P25 shown in Table 2 even if a structure effectively using the cooling steam is adopted for the high-temperature, intermediate-pressure turbine section 90, the economical efficiency of the members, the production cost and the like is impaired in addition to a little reduction of thermal efficiency in comparison with a case that the cooling steam is not used. Besides, the materials other than the materials P16, P24 and P25 have problems such as poor formability and weldability to be used for a large member.

In the steam turbine power plant of the fourth embodiment described above, the casing 91 is formed into a single structure, so that the facility cost can be suppressed in comparison with the high-temperature, intermediate-pressure turbine section provided with a double-structure casing of the inner casing and the outer casing.

The structure for mainly cooling, for example, the casing 91 of the high-temperature, intermediate-pressure turbine section by the cooling steam is provided, so that the casing 91 can be made to have a temperature of 600° C. or less even when the steam introduced through the hot reheat pipe 20 has a temperature of 650° C. or more, for example, 700° C. Thus, such components can be formed of the ferritic heat-resistant steels which are widely used for a conventional steam turbine power plant. And, the high-temperature, intermediate-pressure turbine section, which is following a conventional design concept and has high reliability, can be configured at a low cost.

Besides, because the steam of 650° C. or more is introduced into the high-temperature, intermediate-pressure turbine section 80, the thermal efficiency higher than that of a conventional steam turbine operated by steam of 600° C. or less can be obtained.

In the steam turbine power plant of the fourth embodiment described above, the high-temperature, intermediate-pressure turbine section which is a division of the intermediate-pressure turbine is configured of a single-structure casing, and the steam cooling means for cooling the casing by the cooling steam is disposed. This configuration can also be applied to the intermediate-pressure turbine which is not divided in the second embodiment. And, the embodiments of the present invention can be expanded or modified within the scope of technical idea of the present invention, and the expanded or modified embodiments are also included in the technical scope of the present invention.

It is to be understood that the present invention is not limited to the specific embodiments thereof illustrated herein, and various modifications may be made without departing from the scope of the claims of the invention.

What is claimed is:

1. A steam turbine power plant comprising a high-pressure turbine, an intermediate-pressure turbine and a low-pressure turbine, the intermediate-pressure turbine being separated into a high-temperature, intermediate-pressure turbine into which high-temperature steam having steam exhausted from the high-pressure turbine reheated to 650° C. or more is introduced and a low-temperature, intermediate-pressure turbine into which steam exhausted from the high-temperature, intermediate-pressure turbine is introduced, wherein a steam cooling unit for cooling a rotor of the high-temperature, intermediate-pressure turbine by cooling steam is provided, at least one composing element of the high-pressure turbine, the low-temperature, intermediate-pressure turbine and the low-pressure turbine is formed of a ferritic alloy steel, and the rotor of the high-temperature, intermediate-pressure turbine is formed of, on percentage by weight basis, one alloy steel selected from a group consisting of 10) to 14):

10) an alloy steel consisting of C: 0.08 to 0.15, Si: 0.1 or less, Mn: 0.1 to 0.3, Ni: 0.1 to 0.3, Cr: 9.0 to less than 10.0, V: 0.15 to 0.3, Mo: 0.6 to 1.0, W: 1.5 to 2.0, Co: 1.0 to 4.0, Nb: 0.02 to 0.08, B: 0.001 to 0.015, N: 0.01 to 0.06 and the balance of Fe and unavoidable impurities and having $M_{23}C_6$ type carbide precipitated mainly on grain boundaries and martensitic lath boundaries by a tempering heat treatment, $M_2X$ type carbonitride and MX type carbonitride precipitated within the martensitic lath, a relationship of V>Mo between V and Mo in the component elements of the $M_2X$ type carbonitride, and a total of precipitates of the $M_{23}C_6$ type carbide, the $M_2X$ type carbonitride and the MX type carbonitride being 2.0 to 4.0% by weight;

11) an alloy steel consisting of C: 0.08 to 0.15, Si: 0.1 or less, Mn: 0.1 to 0.8, Ni: 0.1 to 0.8, Cr: 9.0 to less than 11.0, V: 0.15 to 0.3, Mo: 0.8 to 1.4, Nb: 0.02 to 0.3, N: 0.01 to 0.06 and the balance of Fe and unavoidable impurities;

12) an alloy steel consisting of C: 0.08 to 0.15, Si: 0.1 or less, Mn: 0.1 to 0.8, Ni: 0.1 to 0.8, Cr: 9.0 to less than 11.0, V: 0.15 to 0.3, Mo: 0.8 to 1.4, Nb: 0.02 to 0.3, N: 0.01 to 0.06, W: 0.5 to 1.4 and the balance of Fe and unavoidable impurities;

13) an alloy steel consisting of C: 0.13 to 0.35, Si: 0.2 or less, Mn: 0.8 or less, Ni: 0.8 or less, Cr: 0.8 to 1.9, V: 0.2 to 0.35, Ti: 0.01 or less, Mo: 0.7 to 1.4 and the balance of Fe and unavoidable impurities; and 14) an alloy steel consisting of C: 0.13 to 0.35, Si: 0.2 or less, Mn: 0.8 or less, Ni: 0.8 or less, Cr: 0.8 to 1.9, V: 0.2 to 0.35, Ti: 0.01 or less, Mo: 0.7 to 1.4, W: 0.8 to 1.4 and the balance of Fe and unavoidable impurities.

2. The steam turbine power plant according to claim 1, wherein the casing of the high-temperature, intermediate-pressure turbine is comprised of a double structure of an outer casing and an inner casing, and a steam cooling unit for cooling the outer casing by introducing cooling steam between the outer casing and the inner casing is disposed, and the outer casing is formed of, on percentage by weight basis, one alloy steel selected from a group consisting of 15) to 17):

15) an alloy steel consisting of C: 0.05 to 0.15, Si: 0.3 or less, Mn: 0.1 to 1.5, Ni: 1.0 or less, Cr: 9.0 to less than 10.0, V: 0.1 to 0.3, Mo: 0.6 to 1.0, W: 1.5 to 2.0, Co: 1.0 to 4.0, Nb: 0.02 to 0.08, B: 0.001 to 0.008, N: 0.005 to 0.1, Ti: 0.001 to 0.03 and the balance of Fe and unavoidable impurities and having $M_{23}C_6$ type carbide precipitated mainly on grain boundaries and martensitic lath boundaries by a tempering heat treatment, $M_2X$ type carbonitride and MX type carbonitride precipitated within the martensitic lath, a relationship of V>Mo between V and Mo in the component element of the $M_2X$ type carbonitride, and a total of precipitates of the $M_{23}C_6$ type carbide, the $M_2X$ type carbonitride and the MX type carbonitride being 2.0 to 4.0% by weight;

16) an alloy steel consisting of C: 0.05 to 0.16, Si: 0.3 or less, Mn: 0.5 to 0.7, Ni: 0.3 to 0.6, Cr: 9.0 to 10.5, V: 0.1 to 0.3, Mo: 0.6 to 1.0, Nb: 0.02 to 0.08, N: 0.005 to 0.1 and the balance of Fe and unavoidable impurities; and 17) an alloy steel consisting of C: 0.12 to 0.18, Si: 0.3 or less, Mn: 0.5 to 0.9, Ni: 0.5 or less, Cr: 1.0 to 1.5, V: 0.2 to 0.35, Mo: 0.9 to 1.2, Ti: 0.01 to 0.04 and the balance of Fe and unavoidable impurities.

3. The steam turbine power plant according to claim 2, further comprising:

a steam cooling unit for cooling the inner casing of the high-temperature, intermediate-pressure turbine by cooling steam, wherein the inner casing is formed of, on percentage by weight basis, 18) an alloy steel consisting of C: 0.05 to 0.15, Si: 0.3 or less, Mn: 0.1 to 1.5, Ni: 1.0 or less, Cr: 9.0 to less than 10.0, V: 0.1 to 0.3, Mo: 0.6 to 1.0, W: 1.5 to 2.0, Co: 1.0 to 4.0, Nb: 0.02 to 0.08, B: 0.001 to 0.008, N: 0.005 to 0.1, Ti: 0.001 to 0.03 and the balance of Fe and unavoidable impurities and having $M_{23}C_6$ type carbide precipitated mainly on grain boundaries and martensitic lath boundaries by a tempering heat treatment, $M_2X$ type carbonitride and MX type carbonitride precipitated within the martensitic lath, a relationship of V>Mo between V and Mo in the component elements of the $M_2X$ type carbonitride, and a total of precipitates of the $M_{23}C_6$ type carbide, the $M_2X$ type carbonitride and the MX type carbonitride being 2.0 to 4.0% by weight.

4. The steam turbine power plant according to claim 1, wherein the casing of the high-temperature, intermediate-pressure turbine is formed into a single structure, a steam cooling unit for cooling the casing by cooling steam is disposed, and the casing is formed of, on percentage by weight basis, 19) an alloy steel consisting of C: 0.05 to 0.15, Si: 0.3 or less, Mn: 0.1 to 1.5, Ni: 1.0 or less, Cr: 9.0 to less than 10.0, V: 0.1 to 0.3, Mo: 0.6 to 1.0, W: 1.5 to 2.0, Co: 1.0 to 4.0, Nb: 0.02 to 0.08, B: 0.001 to 0.008, N: 0.005 to 0.1, Ti: 0.001 to 0.03 and the balance of Fe and unavoidable impurities and having $M_{23}C_6$ type carbide precipitated mainly on grain boundaries and martensitic lath boundaries by a tempering heat treatment, $M_2X$ type carbonitride and MX type carbonitride precipitated within the martensitic lath, a relationship of V>Mo between V and Mo in the component elements of the $M_2X$ type carbonitride, and a total of precipitates of the $M_{23}C_6$ type carbide, the $M_2X$ type carbonitride and the MX type carbonitride being 2.0 to 4.0% by weight.

5. The steam turbine power plant according to claim 1, wherein at least a first stage turbine blade of the turbine blades constructed of plural stages of the high-temperature, intermediate-pressure turbine is formed of, on percentage by weight basis, one alloy selected from a group consisting of 20) to 24):

20) an alloy consisting of Ni: 50.0 to 55.0, Cr: 17.0 to 21.0, a total of Nb or Nb and Ta: 4.75 to 5.5, Mo: 2.8 to 3.3, Ti: 0.65 to 1.15, Al: 0.2 to 0.8, Co: 1.0 or less, C: 0.08 or less, Mn: 0.35 or less, Si: 0.35 or less, B: 0.006 or less and the balance of Fe and unavoidable impurities;

21) an alloy consisting of C: 0.25 or less, Si: 1.0 or less, Mn: 1.0 or less, Cr: 19.0 to 24.0, Co: 15.0 or less, Mo: 8.0 to 10.0, a total of Nb and Ta: 4.15 or less, Al: 1.5 or less, Ti: 0.6 or less, Fe: 20.0 or less, W: 1.0 or less, B: 0.01 or less and the balance of Ni and unavoidable impurities;

22) an alloy consisting of C: 0.2 or less, Si: 1.0 or less, Mn: 1.0 or less, Cr: 12.0 to 21.0, Co: 22.0 or less, Mo: 10.5 or less, a total of Nb and Ta: 2.8 or less, Al: 0.4 to 6.5, Ti: 0.5 to 3.25, Fe: 9.0 or less, B: 0.02 or less, Zr: 4.0 or less and the balance of Ni and unavoidable impurities;

23) an alloy consisting of C: 0.45 or less, Si: 1.0 or less, Mn: 2.0 or less, Cr: 19.0 to 25.0, Ni: 18.0 to 45.0, Mo: 2.0 or less, Nb: 0.1 to 0.4, W: 8.0 or less, Ti: 0.6 or less, Al: 0.6 or less, B: 0.01 or less, N: 0.25 or less and the balance of Fe and unavoidable impurities; and 24) an alloy consisting of C: 0.1 or less, Si: 1.5 or less, Mn: 1.0 or less, Cr: 11.0 to 20.0, a total of Ni and Co: 40.0 to 60.0, Mo: 2.5 to 7.0, Al: 0.35 or less, Ti: 2.3 to 3.1, Zr: 0.1 or less, B: 0.001 to 0.02 and the balance of Fe and unavoidable impurities.

6. A steam turbine power plant comprising a high-pressure turbine, an intermediate-pressure turbine into which high-temperature steam having steam exhausted from the high-pressure turbine reheated to 650° C. or more is introduced, and a low-pressure turbine into which steam exhausted from the intermediate-pressure turbine is introduced, wherein a steam cooling unit for cooling a rotor of the intermediate-pressure turbine by cooling steam is provided, at least one composing element of the high-pressure turbine and the low-pressure turbine is formed of a ferritic alloy steel, and the rotor of the intermediate-pressure turbine is formed of, on percentage by weight basis, one alloy steel selected from a group consisting of 39) to 43):

39) an alloy steel consisting of C: 0.08 to 0.15, Si: 0.1 or less, Mn: 0.1 to 0.3, Ni: 0.1 to 0.3, Cr: 9.0 to less than 10.0, V: 0.15 to 0.3, Mo: 0.6 to 1.0, W: 1.5 to 2.0, Co: 1.0 to 4.0, Nb: 0.02 to 0.08, B: 0.001 to 0.015, N: 0.01 to 0.06 and the balance of Fe and unavoidable impurities and having $M_{23}C_6$ type carbide precipitated mainly on grain boundaries and martensitic lath boundaries by a tempering heat treatment, $M_2X$ type carbonitride and MX type carbonitride precipitated within the martensitic lath, a relationship of V>Mo between V and Mo in the component elements of the $M_2X$ type carbonitride, and a total of precipitates of the $M_{23}C_6$ type carbide, the $M_2X$ type carbonitride and the MX type carbonitride being 2.0 to 4.0% by weight;

40) an alloy steel consisting of C: 0.08 to 0.15, Si: 0.1 or less, Mn: 0.1 to 0.8, Ni: 0.1 to 0.8, Cr: 9.0 to less than 11.0, V: 0.15 to 0.3, Mo: 0.8 to 1.4, Nb: 0.02 to 0.3, N: 0.01 to 0.06 and the balance of Fe and unavoidable impurities;

41) an alloy steel consisting of C: 0.08 to 0.15, Si: 0.1 or less, Mn: 0.1 to 0.8, Ni: 0.1 to 0.8, Cr: 9.0 to less than 11.0, V: 0.15 to 0.3, Mo: 0.8 to 1.4, Nb: 0.02 to 0.3, N: 0.01 to 0.06, W: 0.5 to 1.4 and the balance of Fe and unavoidable impurities;

42) an alloy steel consisting of C: 0.13 to 0.35, Si: 0.2 or less, Mn: 0.8 or less, Ni: 0.8 or less, Cr: 0.8 to 1.9, V: 0.2 to 0.35, Ti: 0.01 or less, Mo: 0.7 to 1.4 and the balance of Fe and unavoidable impurities; and 43) an alloy steel consisting of C: 0.13 to 0.35, Si: 0.2 or less, Mn: 0.8 or less, Ni: 0.8 or less, Cr: 0.8 to 1.9, V: 0.2 to 0.35, Ti: 0.01 or less, Mo: 0.7 to 1.4, W: 0.8 to 1.4 and the balance of Fe and unavoidable impurities.

7. The steam turbine power plant according to claim 6, wherein a casing of the intermediate-pressure turbine is formed of a double structure of an outer casing and an inner casing, and a steam cooling unit for cooling the outer casing by introducing cooling steam between the outer casing and the inner casing is disposed, and the outer casing is formed of, on percentage by weight basis, one alloy steel selected from a group consisting of 44) to 46):

44) an alloy steel consisting of C: 0.05 to 0.15, Si: 0.3 or less, Mn: 0.1 to 1.5, Ni: 1.0 or less, Cr: 9.0 to less than 10.0, V: 0.1 to 0.3, Mo: 0.6 to 1.0, W: 1.5 to 2.0, Co: 1.0 to 4.0, Nb: 0.02 to 0.08, B: 0.001 to 0.008, N: 0.005 to 0.1, Ti: 0.001 to 0.03 and the balance of Fe and unavoidable impurities and having $M_{23}C_6$ type carbide precipitated mainly on grain boundaries and martensitic lath boundaries by a tempering heat treatment, $M_2X$ type carbonitride and MX type carbonitride precipitated within the martensitic lath, a relationship of V>Mo between V and Mo in the component elements of the $M_2X$ type carbonitride, and a total of precipitates of the $M_{23}C_6$ type carbide, the $M_2X$ type carbonitride and the MX type carbonitride being 2.0 to 4.0% by weight;

45) an alloy steel consisting of C: 0.05 to 0.16, Si: 0.3 or less, Mn: 0.5 to 0.7, Ni: 0.3 to 0.6, Cr: 9.0 to 10.5, V: 0.1 to 0.3, Mo: 0.6 to 1.0, Nb: 0.02 to 0.08, N: 0.005 to 0.1 and the balance of Fe and unavoidable impurities; and 46) an alloy steel consisting of C: 0.12 to 0.18, Si: 0.3 or less, Mn: 0.5 to 0.9, Ni: 0.5 or less, Cr: 1.0 to 1.5, V: 0.2 to 0.35, Mo: 0.9 to 1.2, Ti: 0.01 to 0.04 and the balance of Fe and unavoidable impurities.

8. The steam turbine power plant according to claim 7, further comprising:

a steam cooling unit for cooling the inner casing of the intermediate-pressure turbine by cooling steam, wherein:

the inner casing is formed of, on percentage by weight basis, 47) an alloy steel consisting of C: 0.05 to 0.15, Si: 0.3 or less, Mn: 0.1 to 1.5, Ni: 1.0 or less, Cr: 9.0 to less than 10.0, V: 0.1 to 0.3, Mo: 0.6 to 1.0, W: 1.5 to 2.0, Co: 1.0 to 4.0, Nb: 0.02 to 0.08, B: 0.001 to 0.008, N: 0.005 to 0.1, Ti: 0.001 to 0.03 and the balance of Fe and unavoidable impurities and having $M_{23}C_6$ type carbide precipitated mainly on grain boundaries and martensitic lath boundaries by a tempering heat treatment, $M_2X$ type carbonitride and MX type carbonitride precipitated within the martensitic lath, a relationship of V>Mo between V and Mo in the component elements of the $M_2X$ type carbonitride, and a total of precipitates of the $M_{23}C_6$ type carbide, the $M_2X$ type carbonitride and the MX type carbonitride being 2.0 to 4.0% by weight.

9. The steam turbine power plant according to claim 6, wherein the casing of the intermediate-pressure turbine is formed into a single structure, and a steam cooling unit for cooling the casing by cooling steam is disposed, and the casing is formed of, on percentage by weight basis, 48) an alloy steel consisting of C: 0.05 to 0.15, Si: 0.3 or less, Mn: 0.1 to 1.5, Ni: 1.0 or less, Cr: 9.0 to less than 10.0, V: 0.1 to 0.3, Mo: 0.6 to 1.0, W: 1.5 to 2.0, Co: 1.0 to 4.0, Nb: 0.02 to 0.08, B: 0.001 to 0.008, N: 0.005 to 0.1, Ti: 0.001 to 0.03 and the balance of Fe and unavoidable impurities and having $M_{23}C_6$ type carbide precipitated mainly on grain boundaries and martensitic lath boundaries by a tempering heat treatment, $M_2X$ type carbonitride and MX type carbonitride precipitated within the martensitic lath, a relationship of V>Mo between V and Mo in the component elements of the $M_2X$ type carbonitride, and a total of precipitates of the $M_{23}C_6$ type carbide, the $M_2X$ type carbonitride and the MX type carbonitride being 2.0 to 4.0% by weight.

10. The steam turbine power plant according to claim 1, wherein the cooling steam is steam exhausted from the high-pressure turbine or steam extracted from the high-pressure turbine.

* * * * *